US009028031B2

(12) United States Patent
Clark et al.

(10) Patent No.: US 9,028,031 B2
(45) Date of Patent: May 12, 2015

(54) PEAK ENERGY REDUCTION PRINTHEAD SYSTEM

(75) Inventors: Garrett E. Clark, Corvallis, OR (US); Chris Bakker, Corvallis, OR (US); Eric T. Martin, Corvallis, OR (US); Vincent Gerard Heesen, San Diego, CA (US); Mark H. Mackenzie, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,807

(22) PCT Filed: Jan. 31, 2012

(86) PCT No.: PCT/US2012/023380

§ 371 (c)(1),
(2), (4) Date: Jul. 25, 2014

(87) PCT Pub. No.: WO2013/115804

PCT Pub. Date: Aug. 8, 2013

(65) Prior Publication Data

US 2015/0022575 A1 Jan. 22, 2015

(51) Int. Cl.

| | |
|---|---|
| ***B41J 2/15*** | (2006.01) |
| ***B41J 2/045*** | (2006.01) |
| ***B41J 2/21*** | (2006.01) |

(52) U.S. Cl.

CPC ..... *B41J 2/0457* (2013.01); *B41J 2/2132* (2013.01)

(58) Field of Classification Search

CPC ..... B41J 2/07; B41J 2/2121; B41J 2/2052; B41J 2/04501; B41J 2/04543; B41J 2/0457; B41J 2/01

See application file for complete search history.

(56) References Cited

U.S. PATENT DOCUMENTS

| | | | | |
|---|---|---|---|---|
| 5,815,173 | A | 9/1998 | Silverbrook | |
| 5,826,994 | A | 10/1998 | Palmer | |
| 6,264,298 | B1 | 7/2001 | Mantell | |
| 6,603,496 | B2 | 8/2003 | Nagumo et al. | |
| 6,932,453 | B2 | 8/2005 | Feinn et al. | |
| 7,253,828 | B2 | 8/2007 | Ng et al. | |
| 7,258,411 | B2 | 8/2007 | Anderson et al. | |
| 7,455,378 | B2 | 11/2008 | Rueby | |
| 7,618,112 | B2 * | 11/2009 | Edamura et al. | 347/15 |
| 8,630,017 | B2 * | 1/2014 | Kanematsu et al. | 358/1.9 |
| 8,926,053 | B2 * | 1/2015 | Hatanaka | 347/19 |

FOREIGN PATENT DOCUMENTS

KR 20060085490 A 7/2006

OTHER PUBLICATIONS

International Search Report and Written Opinion dated Oct. 18, 2012 issued on PCT Patent Application No. PCT/US2012/023380 dated Jan. 31, 2012, Korean Intellectual Property Office.

* cited by examiner

*Primary Examiner* — Lamson Nguyen
(74) *Attorney, Agent, or Firm* — Mannava & Kang, P.C.

(57) ABSTRACT

A printhead system to reduce peak energy usage may include a printhead including a plurality of primitives including nozzles. A printhead control module may control the printhead to increase printed pixel resolution and to reduce peak pixel fill density for print media. The printhead control module may further control the printhead such that all the nozzles with a same address generally disposed in a column do not fire at the same time.

15 Claims, 23 Drawing Sheets

LOW NOZZLE DENSITY AND HIGH FIRING FREQUENCY

FIRE NEIGHBOR AT HIGH FLUIDIC FREQUENCY

FIRE NEIGHBOR AT HIGH FLUIDIC FREQUENCY

PEAK ENERGY REDUCTION PRINTHEAD SYSTEM

BACKGROUND

A printhead, for example, for an ink jet printer may include a series of nozzles disposed in a predetermined pattern to spray drops of ink onto print media. The printhead may include the nozzles electrically connected to a printhead controller by a series of metal traces. The metal traces may be connected to the nozzles for direct control of individual nozzles or groups of nozzles.

In many instances, ink jet printers are designed to print a vertical row of dots or a horizontal row of dots, generally all at the same time, from multiple nozzles. Then, after waiting a period of time, another row of dots is printed all at the same time. To fire many nozzles simultaneously, a large amount of energy is to be provided over a short period of time via the metal traces. Because the metal traces on a printhead are generally thin, they have limited current carrying capacity. This can be overcome by increasing the trace thickness or width or using lower resistivity conductor material, such as gold. However, these design changes can result in increased costs and decreased reliability caused by a higher drive voltage.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
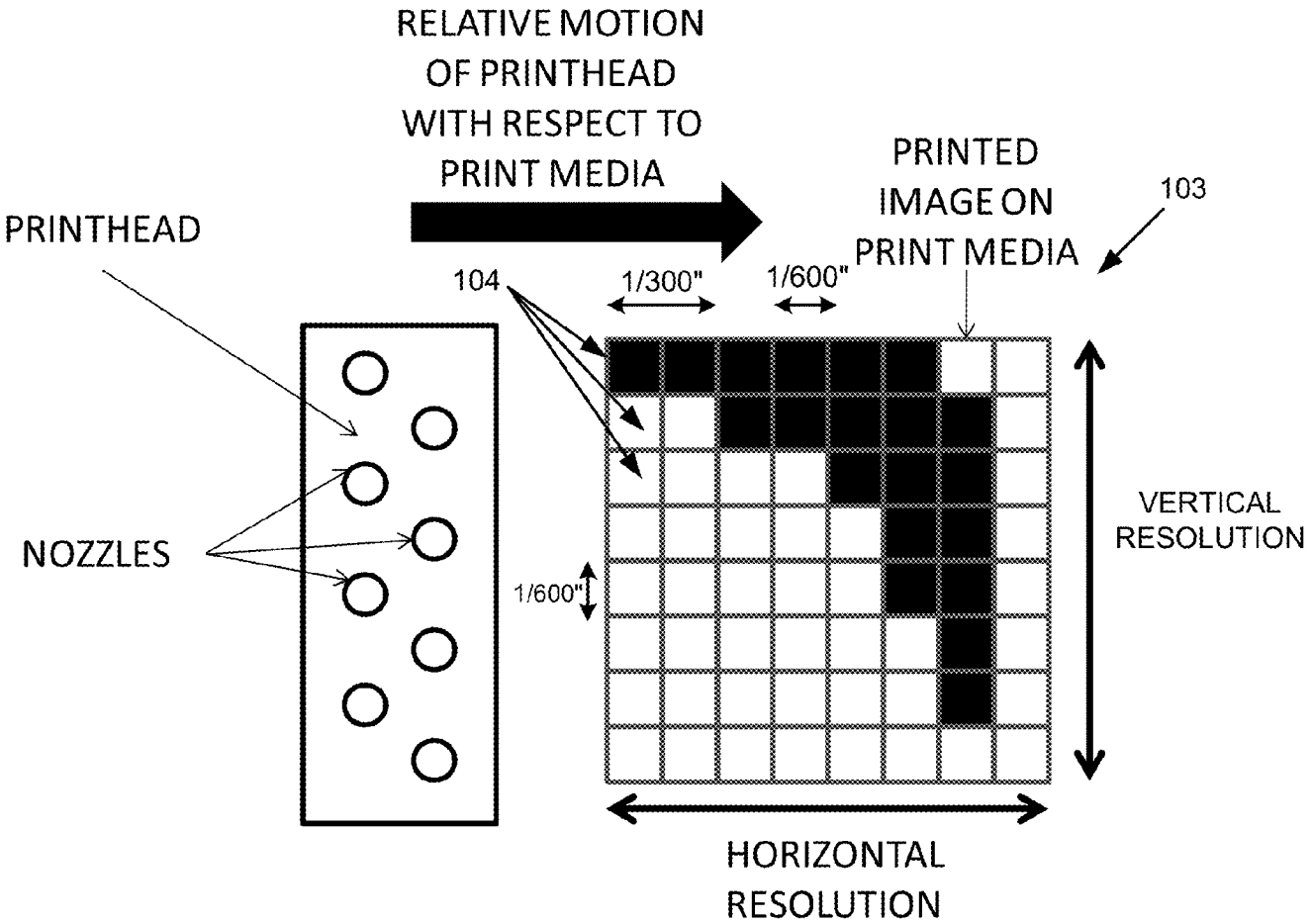
FIG. 1 illustrates an example of a print area including a plurality of pixels and ink fill density options, and a printhead scanning across the print area in a horizontal direction with nozzles arranged in generally vertical columns, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A printhead system is described herein and provides for reduced peak electrical current without print speed compromise. The printhead system may generally include a printhead and a printhead control module. The modules and other components of the printhead system may include machine readable instructions, hardware or a combination of machine readable instructions and hardware. As described in detail below, the printhead system may provide an increase in printed pixel resolution. For example, the electrical frequency may be set such that a print drop may be fired at twice the resolution used for a file. For example, a 600 dpi print amount may be electrically printed at 1200 dpi (i.e., twice the electrical density).

The printhead system may limit the number of droplets that can be fired in each pixel. For example the printhead system may limit peak pixel fill density to 50% of the electrical opportunities to fire drops into a pixel, and ink fill density to a maximum of two drops per pixel. These limits may be accommodated by increasing the number of electrical opportunities to fire drops into each pixel. Thus, the maximum fill level for any pixel remains at 100% fill, although only 50% of the electrical opportunities to fire a drop are used.

The printhead system may further include selective choice of a pattern used to fill a pixel, sometimes called an expansion mask, and a corresponding electrical primitive and address layout. A primitive is a group of nozzles on a printhead, where the printhead has the electrical capability to fire a limited number of nozzles (e.g., usually one) per primitive at any instant in time. Each nozzle in a primitive may be given an address, and all nozzles in the printhead with the same address (regardless of primitive group) may be fired at the same instant in time. The printhead system may include selection of an odd number of nozzles per primitive along with an expansion mask that has a pattern that repeats with an even number of pixels. Alternatively, the printhead system may include an even number of nozzles per primitive along with an expansion mask that repeats with an odd number of pixels. Thus, generally, the printhead system may include a number of nozzles per primitive and an expansion mask combination, such that all addresses on the printhead that share electrical power routing lines do not fire at the same time. Thus, the mask for filling the area filled with a double dpi grid and the printhead may be designed such that the maximum number of simultaneously firing nozzles is reduced by one-half, compared to, for example, a print system that utilizes an even number of addresses per primitive and an expansion mask that repeats on an even number of pixels.

Based on the foregoing, the printhead system may decrease peak instantaneous electrical current on the printhead by at least approximately 50%. This reduction in peak electrical current may produce more uniform energy distribution by reducing parasitic electrical losses, and allow the use of a smaller or less expensive power supply or power distribution system.

FIGS. 1-4 illustrate examples of print areas including a plurality of pixels and ink fill density options. FIG. 1 further illustrates a printhead scanning across a print area in a horizontal direction with nozzles arranged in two generally vertical columns. FIGS. 5A-5K illustrate an example of a sequential firing order for a printhead system 100 including staggered nozzles, according to an example of the present disclosure. The staggered nozzles, and generally, any pattern of adjacently disposed nozzles, may nevertheless be considered as being generally disposed in a column. Generally, the printhead system 100 may include a printhead 101 and associated printhead control module 102, which are shown in FIGS. 5A and 6A. Before proceeding further with a description of the printhead system 100, aspects related to ink fill density are described with reference to FIGS. 1-4 for providing a basis for the operation of the printhead system 100.

FIG. 1 illustrates an example of a print area 103 including a plurality of pixels 104. Referring to FIG. 1, the amount of ink used to produce a saturated color depends on the ink and drop size. Generally, the amount of ink used to produce a saturated color may be approximately 18 ng per 600 dpi pixel (i.e., 18 ng/600$^{th}$ for black ink). For purposes of this example, FIG. 1 shows the print area 103 including $1/1600^{th}$ inch pixels. For approximately 9 ng per drop, the amount of ink used to produce a saturated color may equate to approximately two drops per 600 dpi pixel. For example, for printing in 1200×1200 dpi mode, electrically, there are four locations within a 600 dpi pixel where a drop of ink may be placed. Therefore, only half of the possible locations are to be printed to obtain a fully saturated color.

Figures 2, 3, 4:
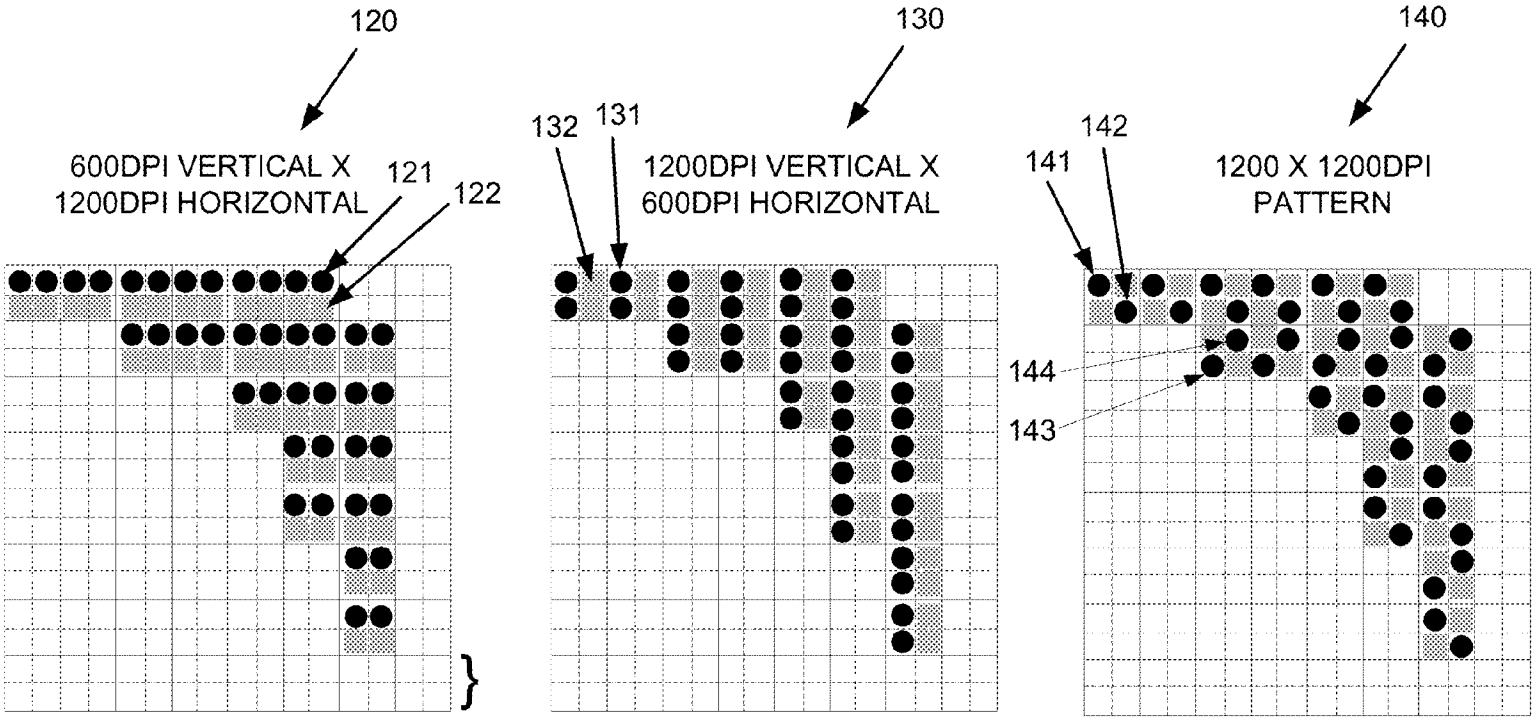
FIG. 2 illustrates an example of a print area including an ink fill density pattern based on low nozzle density and high fluidic frequency, according to an example of the present disclosure.
FIG. 3 illustrates an example of a print area including an ink fill density pattern based on high nozzle density and low fluidic frequency, according to an example of the present disclosure.
FIG. 4 illustrates an example of a print area including an ink fill density pattern based on high nozzle density and low fluidic frequency, but with high electrical frequency, according to an example of the present disclosure.

FIGS. 2-4 illustrate examples of print areas including ink fill density patterns. For FIGS. 2-4, nozzle density refers to how tightly nozzles are physically placed in vertical columns. Fluidic frequency refers to how often a single nozzle is fired as the printhead moves horizontally relative to the print media. Electrical frequency refers to the frequency at which nozzles may be fired as the printhead moves horizontally across the print media (i.e., in the case of FIG. 4, the electrical print frequency is twice the fluidic frequency of any given nozzle).

FIG. 2 illustrates an example of a print pattern 120 based on low nozzle density and high fluidic frequency, according to an example of the present disclosure. For example, FIG. 2 may illustrate a 600 dpi vertical×1200 dpi horizontal print pattern. As shown in FIG. 2, the printhead control module 102 may control the printhead 101 to print a horizontal row 121 of dots [i.e., drops]. No physical nozzles exist between each row 122, so no dots may be printed in these pixels. For the print pattern 120 of FIG. 2, for printing of the rows 121, the printhead system 100 may use all nozzles at 100% duty cycle. This printhead design is sensitive to nozzle defects because all of the ink in each pixel is provided by a single nozzle. One way to remove this sensitivity is to increase the vertical nozzle density.

FIG. 3 illustrates an example of a vertical print pattern 130 based on high nozzle density and low fluidic frequency, according to an example of the present disclosure. For example, FIG. 3 may illustrate a 1200 dpi vertical×600 dpi horizontal print pattern. The printhead control module 102 may control the printhead 101 to print a vertical column 131 of dots. Between each column 132, the printhead 101 may wait prior to printing of another row of dots. For the vertical print pattern 130 of FIG. 3, for printing of the columns 131, the printhead system 100 may use twice as much peak energy compared to the print pattern 120 of FIG. 2. Between each column 132, the printhead system 100 may use virtually no energy. Thus, the printhead system 100 may alternate between relatively large demands of energy (i.e., approximately 100% energy usage) for printing of the columns 131 and relatively no energy usage at the columns 132 (i.e., approximately 0% energy usage). Thus, even though the average energy usage amounts to approximately 50% of peak energy usage, the vertical print pattern 130 still uses approximately 100% energy for printing of the columns 131. Further, for FIG. 3, the system power supply and power distribution system is to be designed to provide the peak power levels. The system 100 however provides for the distribution of energy to reduce the overall energy demand at any given time on the system.

FIG. 4 illustrates an example of a checkerboard print pattern 140 based on high nozzle density and high electrical frequency, according to an example of the present disclosure. For example, FIG. 4 may illustrate a 1200×1200 dpi print pattern. As shown in FIG. 4, the printhead control module 102 may control the printhead 101 to limit peak pixel fill density to 50% of available pixels, and ink fill density to a maximum of two drops per 600 dpi pixel. This system may also provide decreased sensitivity to defective nozzles when compared to the fill pattern of FIG. 2. Compared to the fill patterns of FIG. 3, for FIG. 4, the printhead control module 102 may control the printhead 101 to print a dot 141, and then a dot 142 as described in detail below with reference to FIGS. 6A-6U. For the checkerboard print pattern 140 of FIG. 4, for printing of the dots 141 and 142, the printhead system 100 may use at most approximately 50% peak electrical current compared to the fill pattern of FIG. 3. This reduction in peak electrical current may produce more uniform energy distribution by reducing parasitic electrical losses.

Referring to FIG. 4, it can be seen that the dots 141 and 142 are printed in a top left to bottom right pattern. Further, dots 143 and 144 are printed in an opposite pattern (i.e., bottom left to top right). If the checkerboard pattern is not printed in the alternating pattern of FIG. 4, referring to FIG. 6A (see discussion below), each column of primitives 150, 151 and 152, or 153, 154 and 155 prints at approximately 100% energy density for at least part of the printing process.

FIGS. 5A-5K illustrate an example of a sequential firing order for the printhead system 100 including the printhead 101 including staggered nozzles, according to an example of the present disclosure. In the example illustrated, the printhead 101 may include the primitives 150-155, each including staggered nozzles. The nozzles (and nozzle address) for each primitive may be designated by the corresponding primitive designation. For example, for primitive 150, the nozzles may be designated nozzles 150-1, 150-2, 150-3, 150-4 and 150-5; the nozzles for primitive 151 may be designated nozzles 151-1, 151-2, 151-3, 151-4 and 151-5; and so forth. As discussed above, although each nozzle in a primitive may be given an address, and all nozzles in the printhead with the same address (regardless of primitive group) may be fired at the same instant in time, for FIGS. 5A-5K and 6A-6U, each nozzle is given a different address for facilitating a description of the print sequence of FIGS. 5A-5K and 6A-6U. The dashed lines of FIG. 5A illustrate examples of traces for controlling the nozzles, with the traces being illustrated for the nozzles for the primitives 150 and 153. Similar traces are extended to the primitives 151, 152, 154 and 155. The primitives 150-152 may be disposed on one side of a slot 156, and the primitives 153-155 disposed on the other side of the slot 156. The slot 156 may represent a slot through a silicon layer through which ink flows. Print media 157 may include media where pixels 158 are printed. The pixels 158, for example, are divided in four compartments in a similar manner as shown in FIGS. 2-4. In the example illustrated, the printhead 101 may move in the relative direction to the print media 157 and fire downwards toward the print media 157. For illustrative purposes, the printhead 101 is shown on the left of the print media 157 to illustrate firing of the nozzles and placement of ink on the print media 157.

Figure 5B:
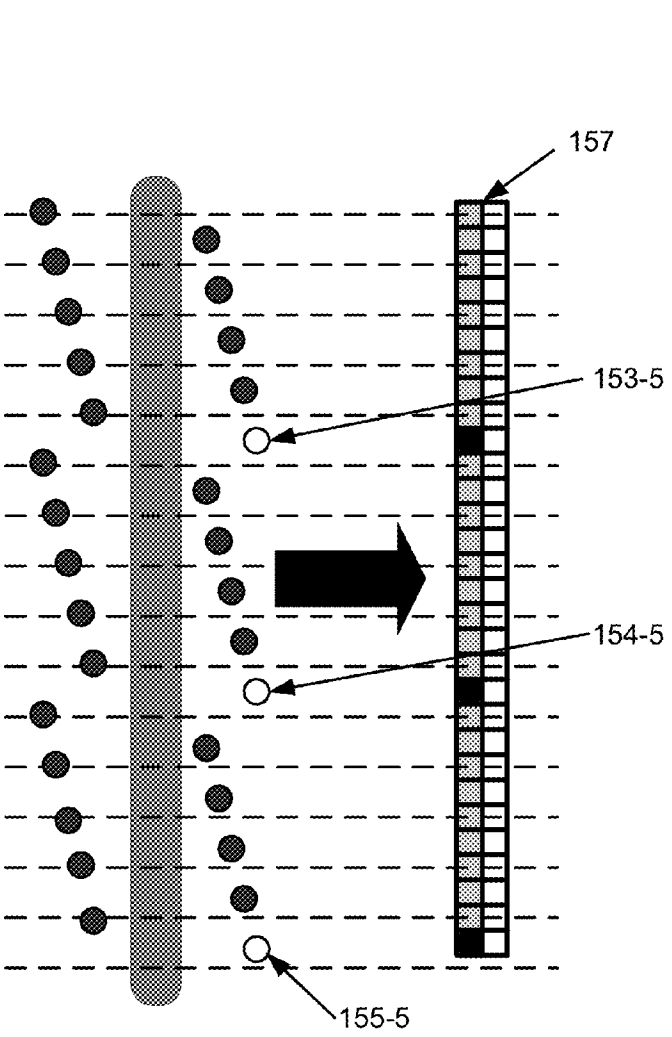
FIGS. 5A-5K illustrate an example of a sequential firing order for a printhead system including a printhead including staggered nozzles, according to an example of the present disclosure.
Figure 5A:
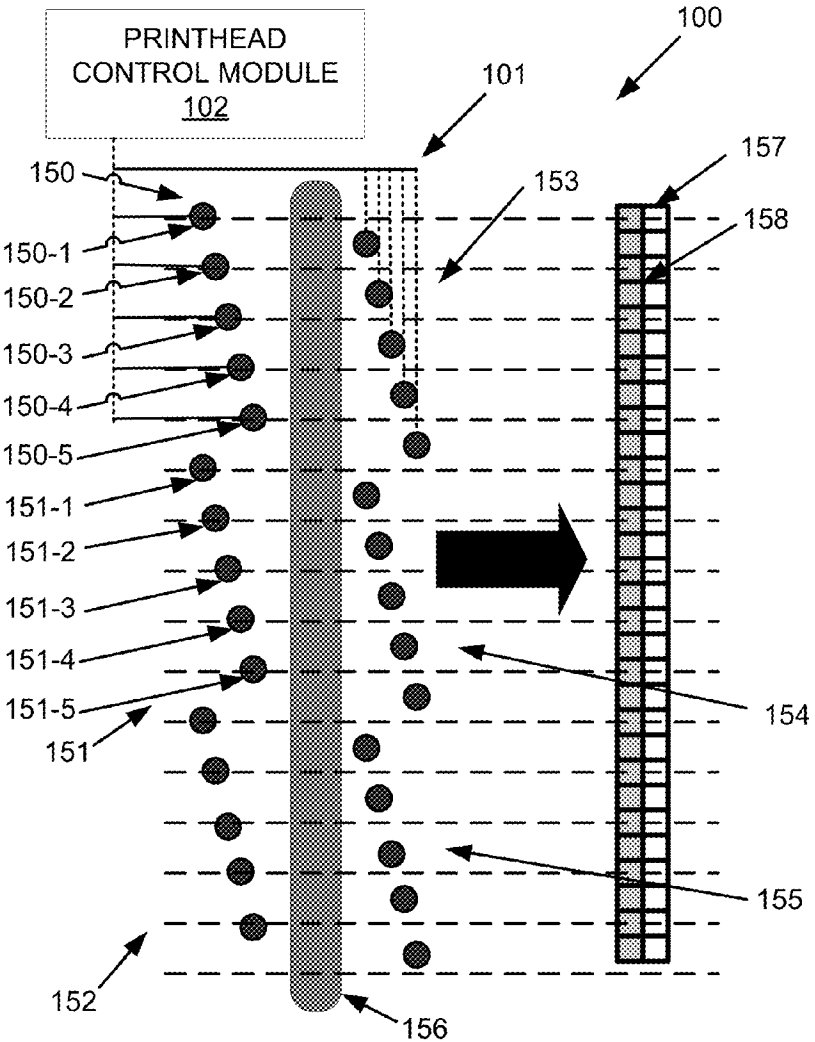
Figure 5D:
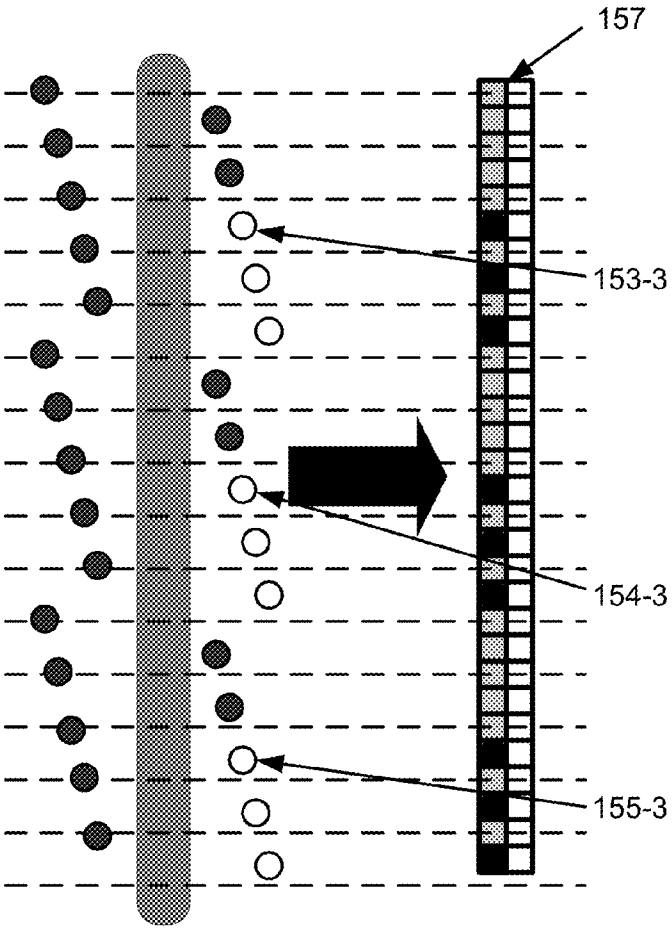
Figure 5C:
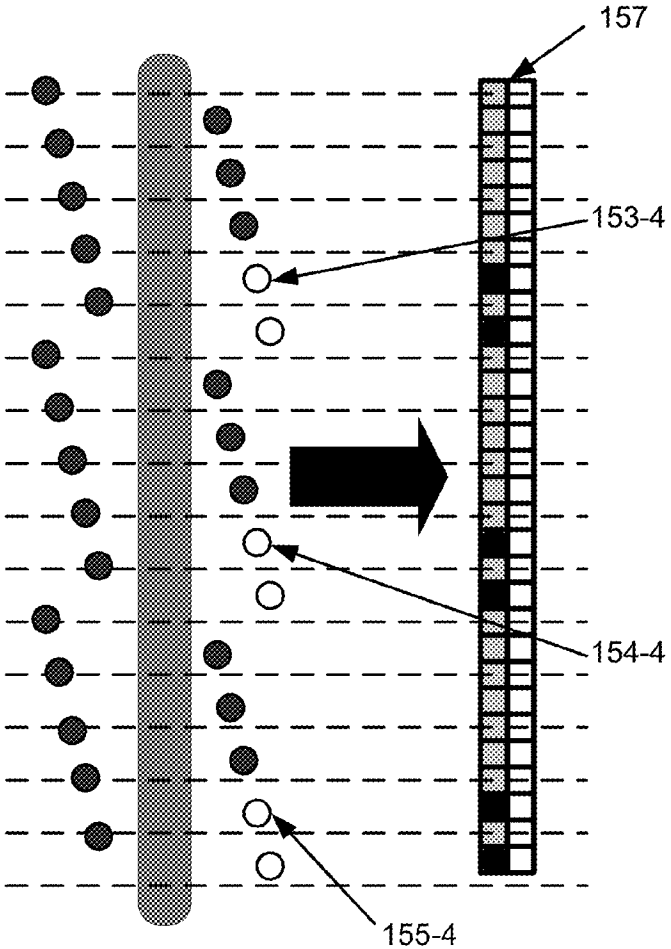
Figure 5F:
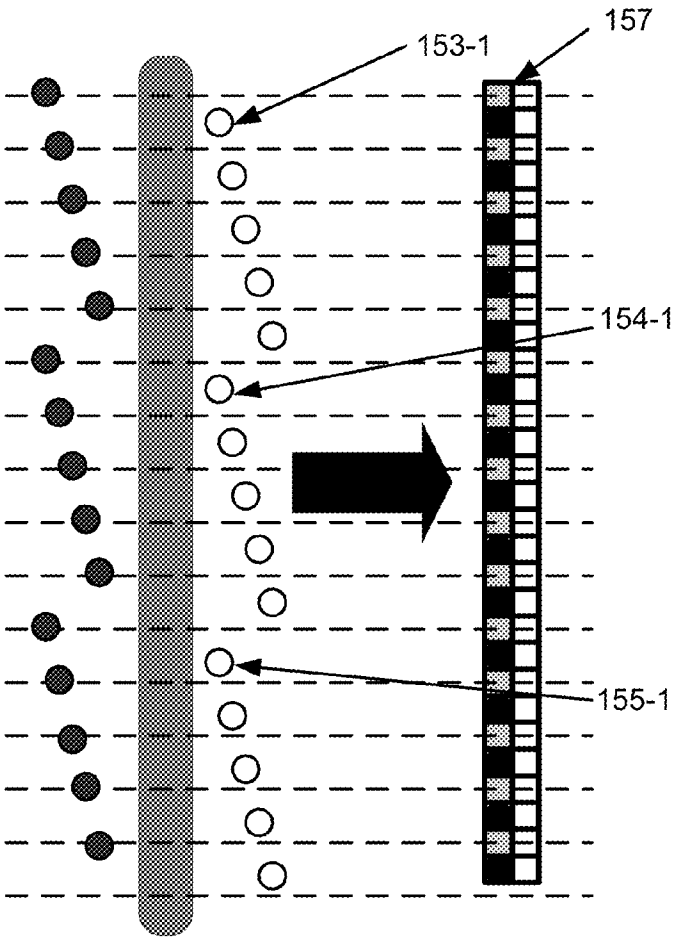
Figure 5E:
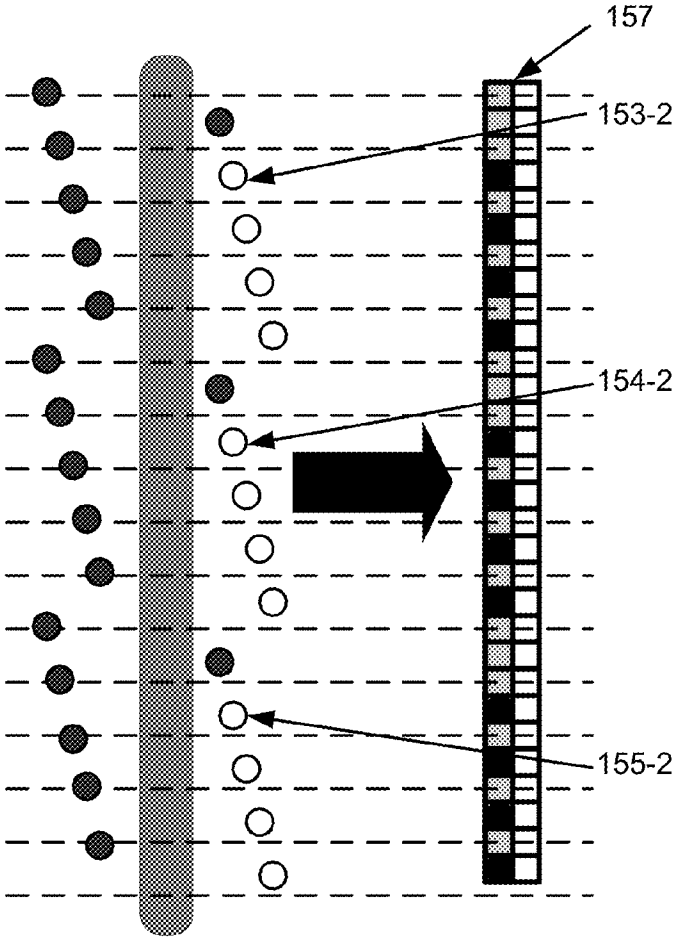
Figure 5H:
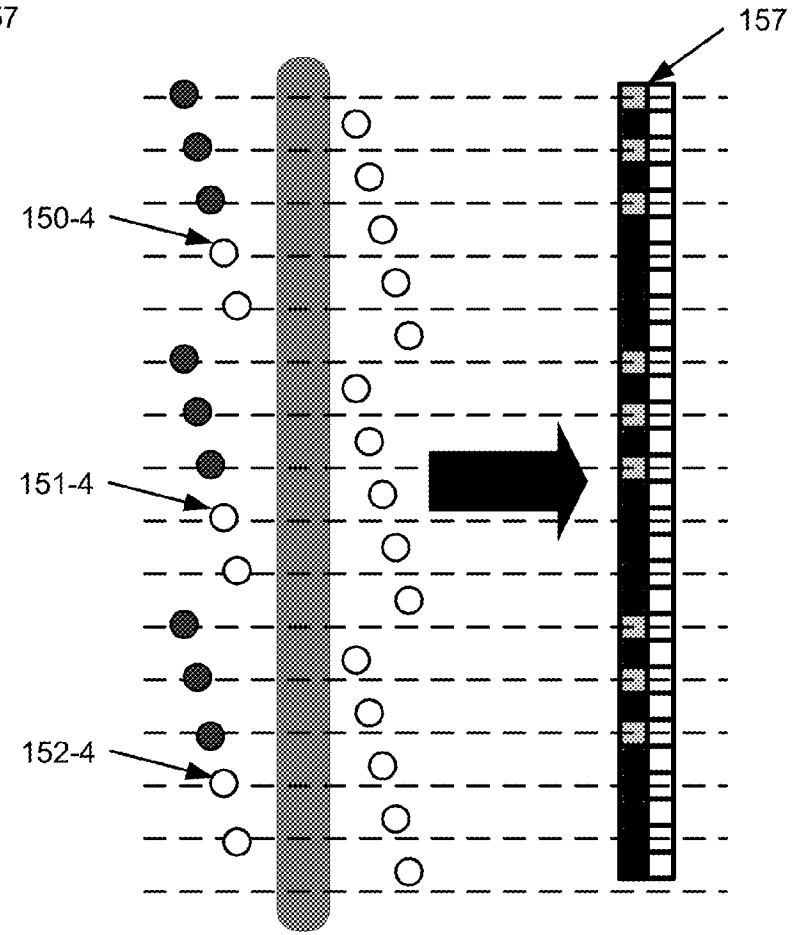
Figure 5G:
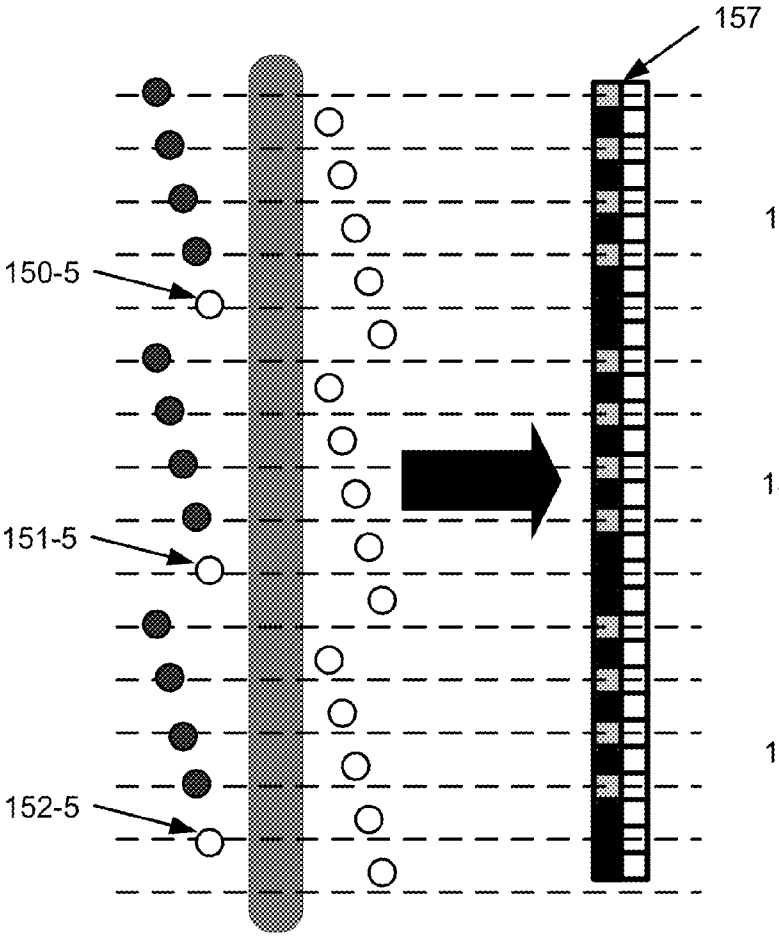
Figure 5J:
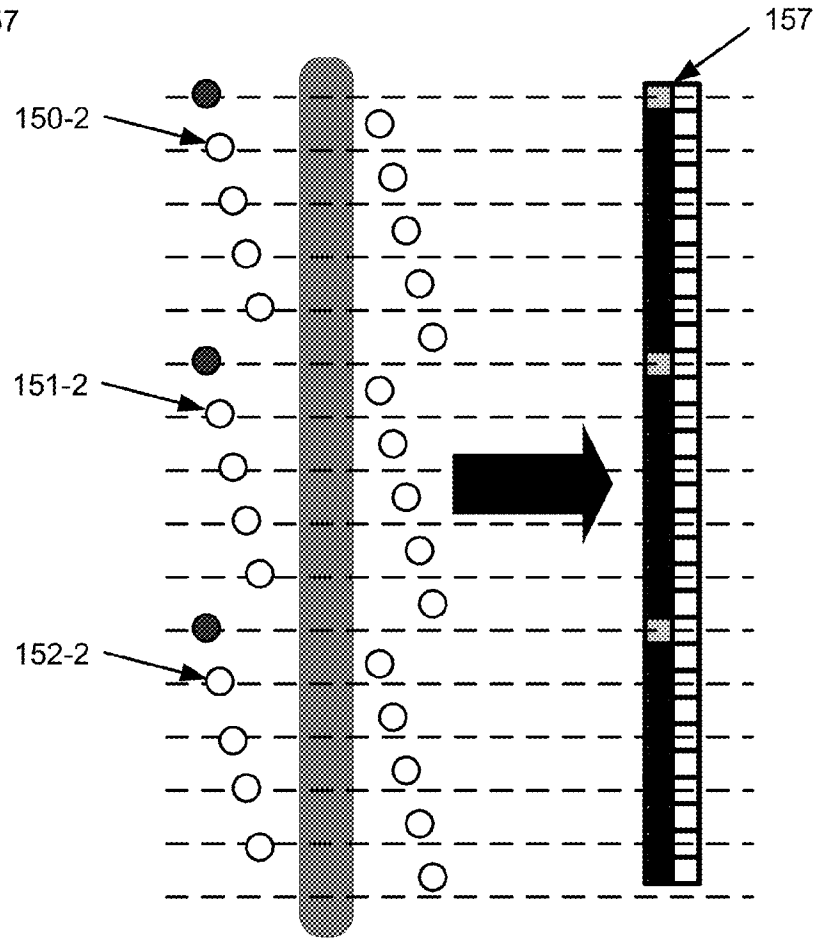
Figure 5I:
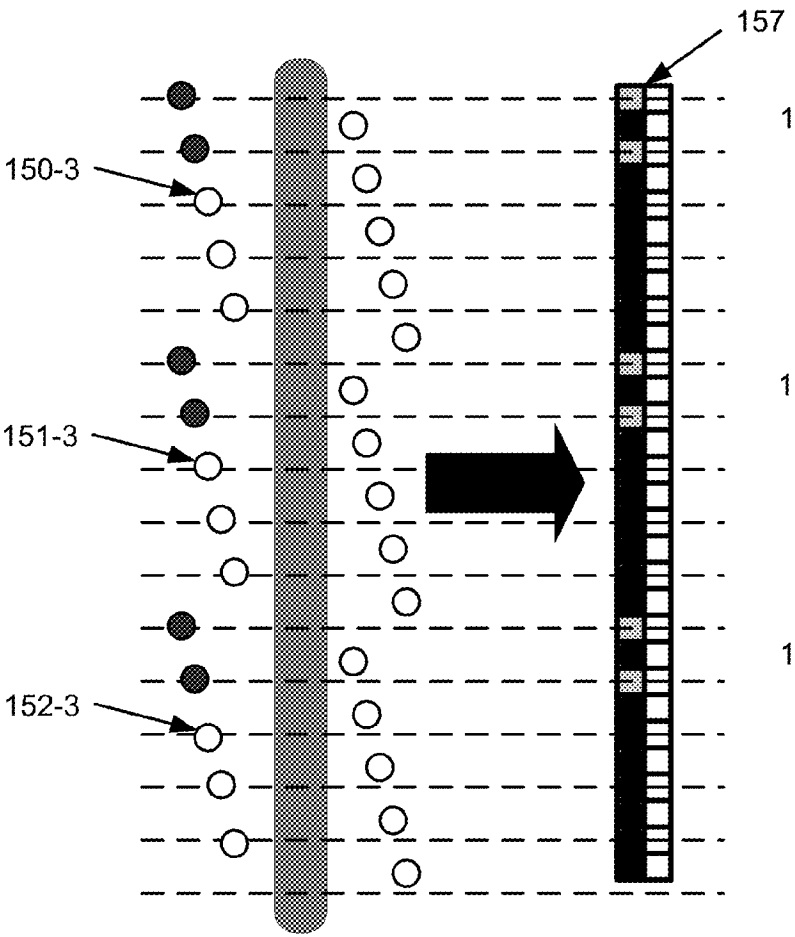
Figure 5K:
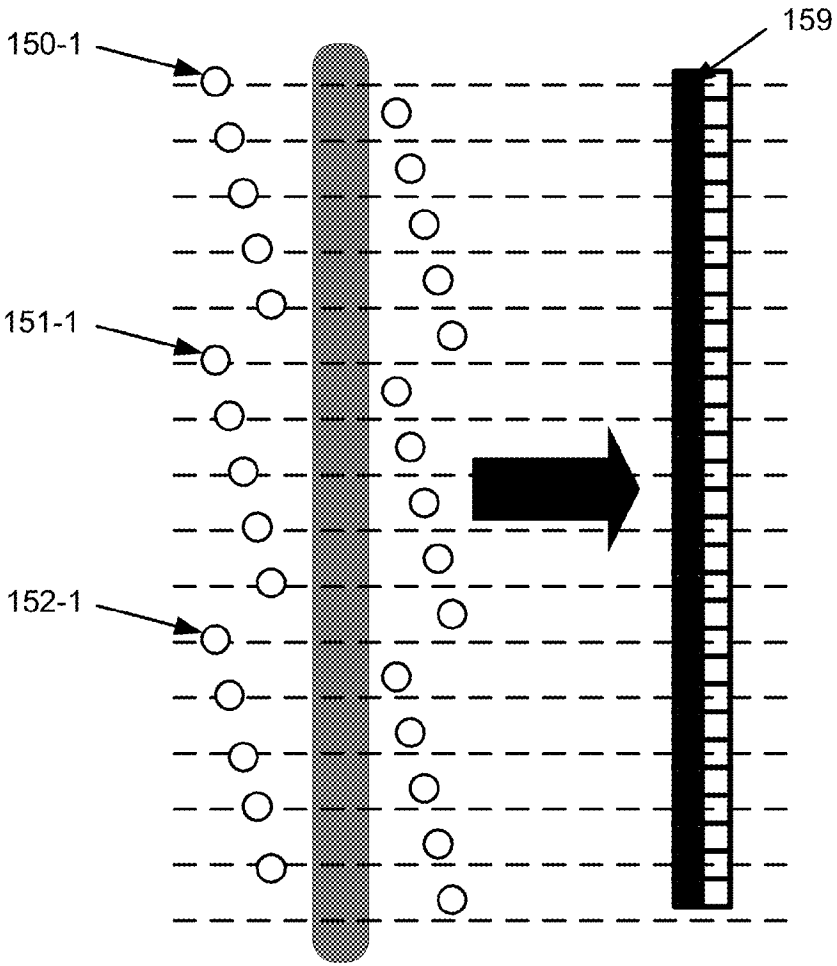

Referring to FIGS. 5A and 5B, in order to print pattern 159 of FIG. 5K (i.e., the print pattern of FIG. 3), in FIG. 5B, nozzles addressed 153-5, 154-5 and 155-5 may be fired at the print media 157. Referring to FIG. 5C, then subsequently nozzles 153-4, 154-4 and 155-4 may be fired at the print media 157. Referring to FIG. 5D, then subsequently nozzles 153-3, 154-3 and 155-3 may be fired at the print media 157. Referring to FIG. 5E, then subsequently nozzles 153-2, 154-2 and 155-2 may be fired at the print media 157. Referring to FIG. 5F, then subsequently nozzles 153-1, 154-1 and 155-1 may be fired at the print media 157. Referring to FIG. 5G, then subsequently nozzles 150-5, 151-5 and 152-5 may be fired at the print media 157. Referring to FIG. 5H, then subsequently nozzles 150-4, 151-4 and 152-4 may be fired at the print media 157. Referring to FIG. 5I, then subsequently nozzles 150-3, 151-3 and 152-3 may be fired at the print media 157. Referring to FIG. 5J, then subsequently nozzles 150-2, 151-2 and 152-2 may be fired at the print media 157. Referring to FIG. 5K, then subsequently nozzles 150-1, 151-1 and 152-1 may be fired at the print media 157.

Thus, referring to FIGS. 5A-5K, one nozzle per primitive is fired at any given time. For the example of FIGS. 5A-5K, all nozzles with the same address are fired simultaneously in the first half of the pixel and then no nozzle is fired for the remaining half of the pixel (e.g., see FIG. 3). Thus, for any given firing event, all nozzles with the same address on one side of the slot 156 are fired. This results in a high peak energy usage for each firing event. Further, although FIGS. 5A-5K show three primitives per side of the slot 156 and a sequential firing order, a larger number of primitives may also be used with a non-sequential firing order to reduce crosstalk. However, even with a larger number of primitives and non-sequential firing order, for any given firing event, all nozzles with the same address on one side of the slot 156 are fired simultaneously.

Figure 6B:
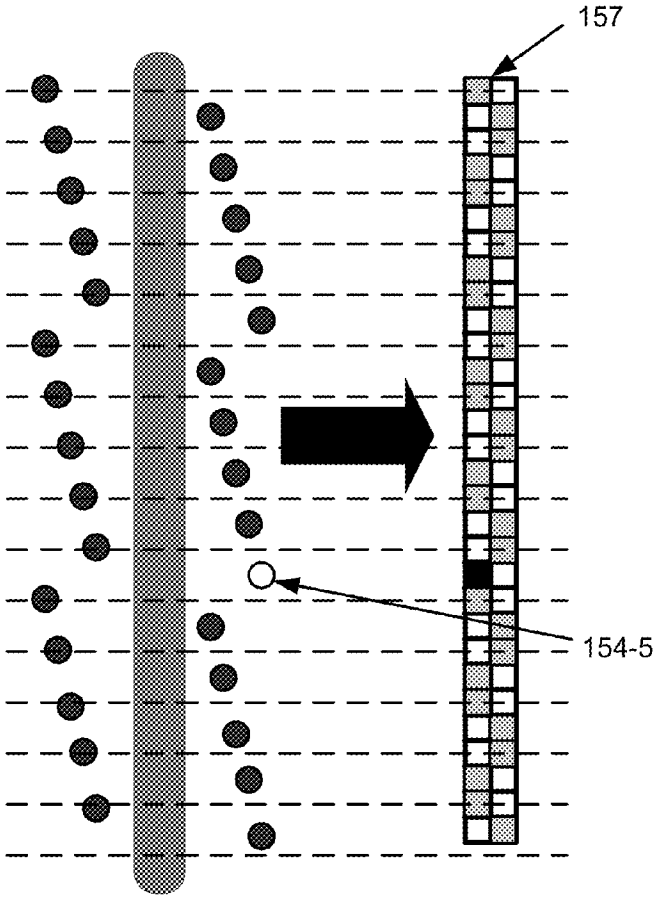
FIGS. 6A-6U illustrate an example of another sequential firing order for reducing peak current for the printhead of FIGS. 5A-5K, according to an example of the present disclosure.
Figure 6A:
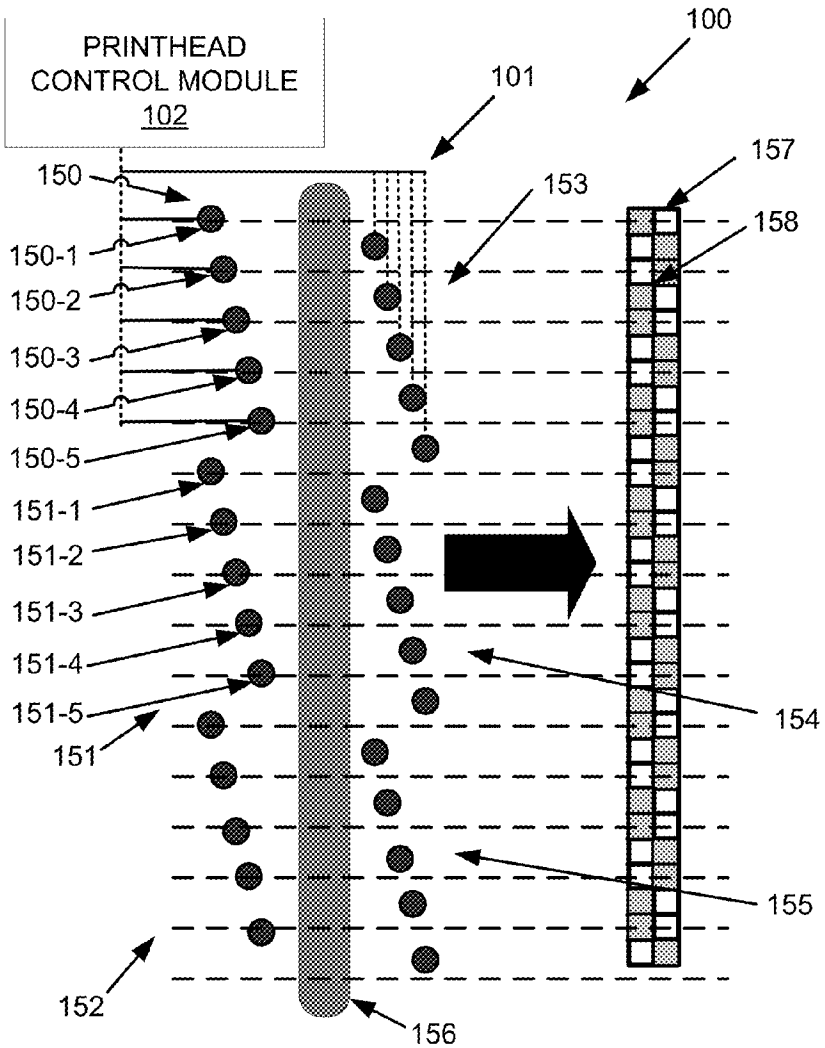
Figure 6D:
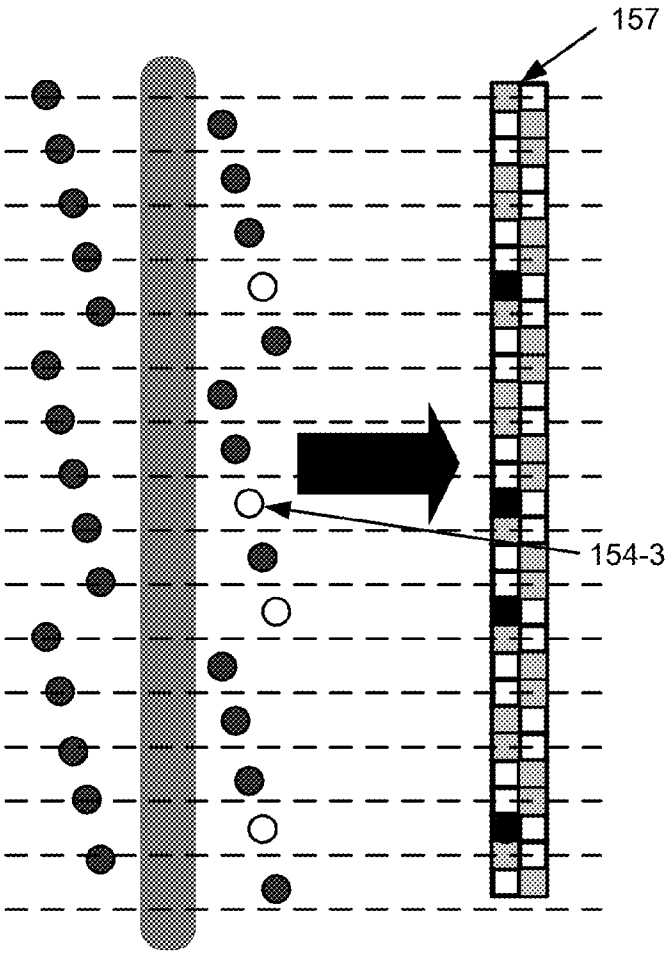
Figure 6C:
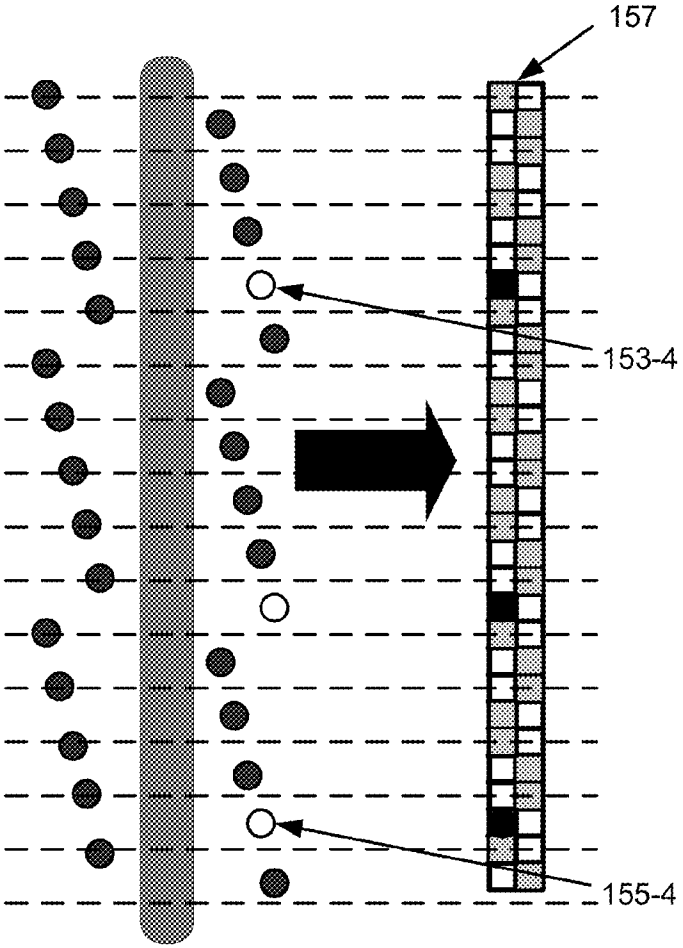
Figure 6F:
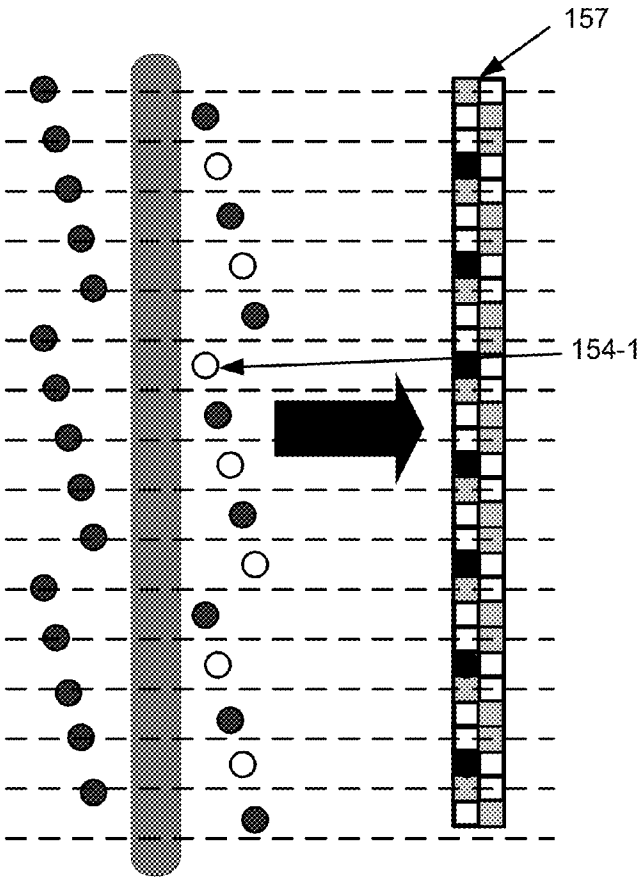
Figure 6E:
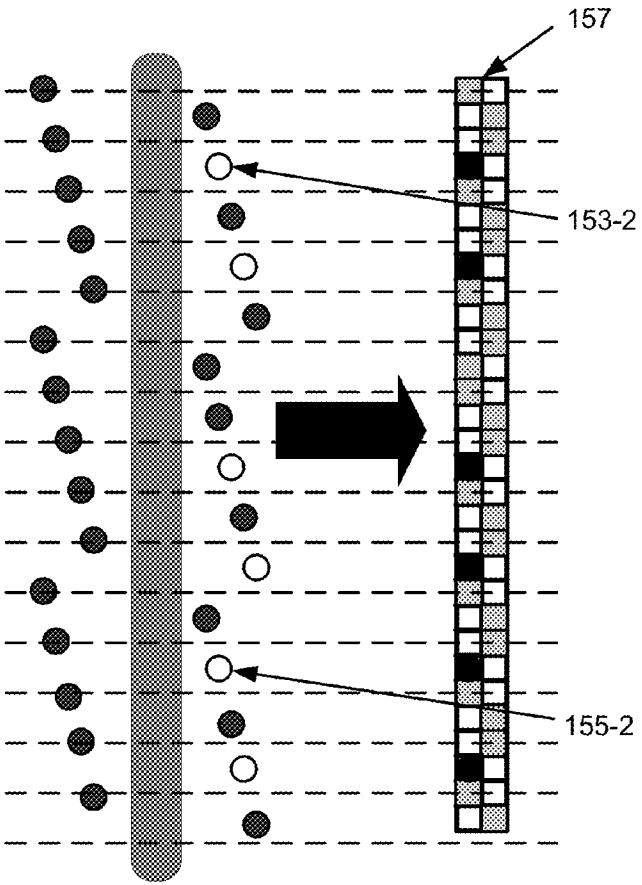
Figure 6H:
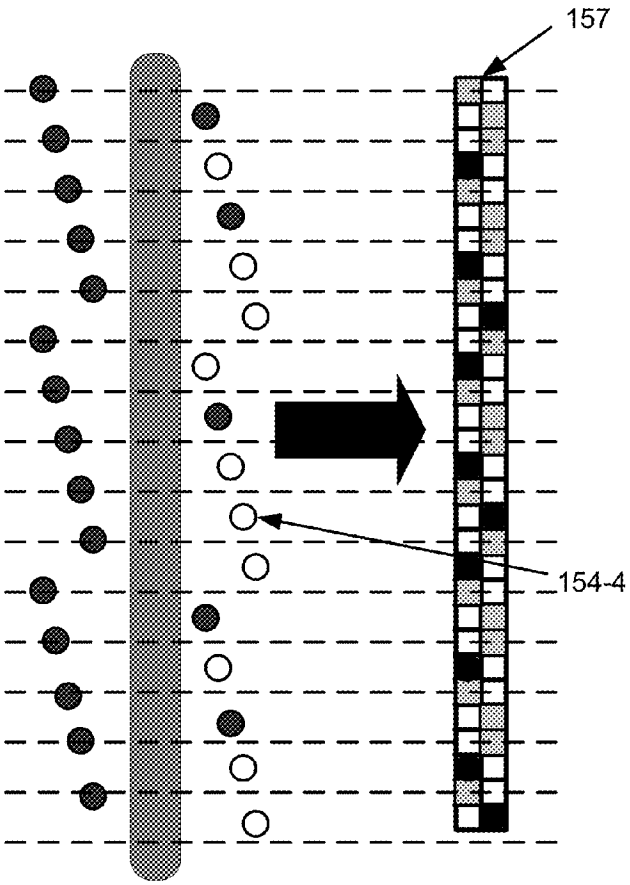
Figure 6G:
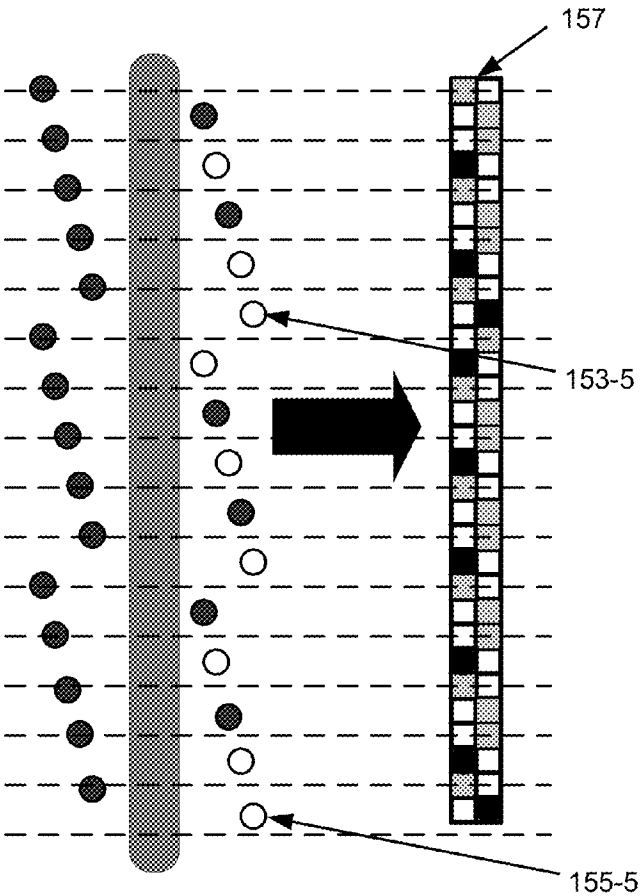
Figure 6J:
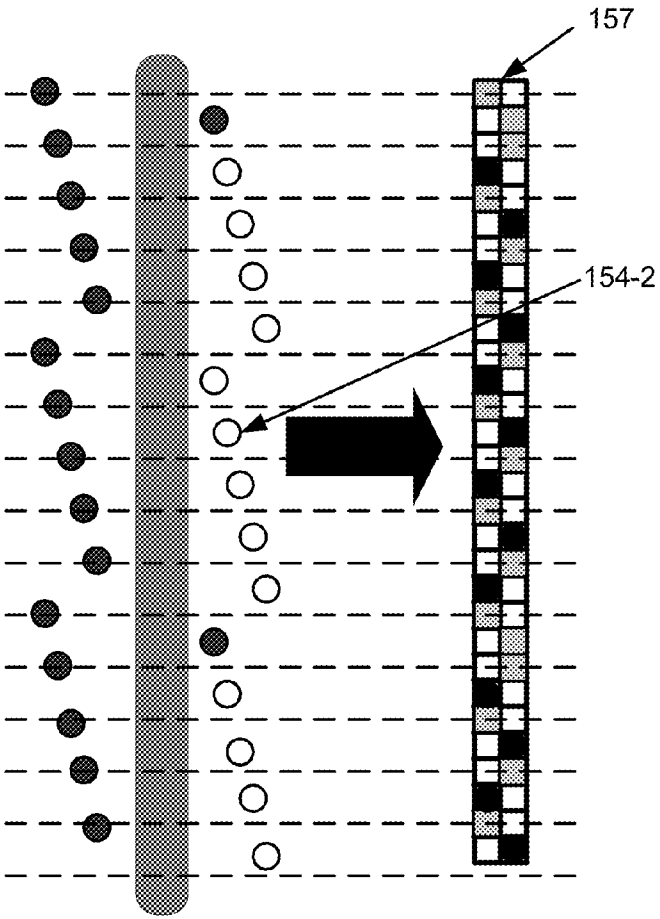
Figure 6I:
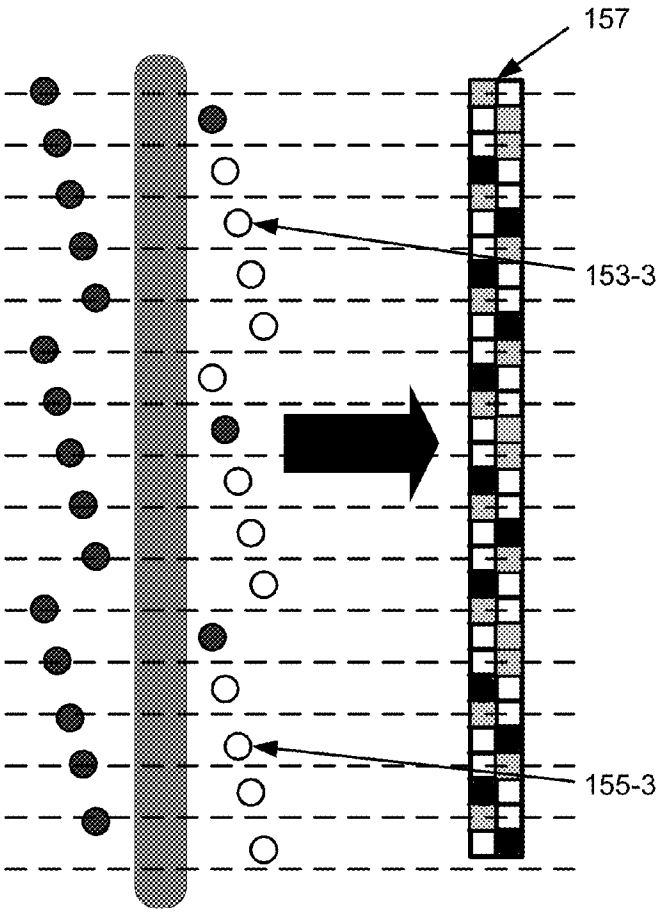
Figure 6L:
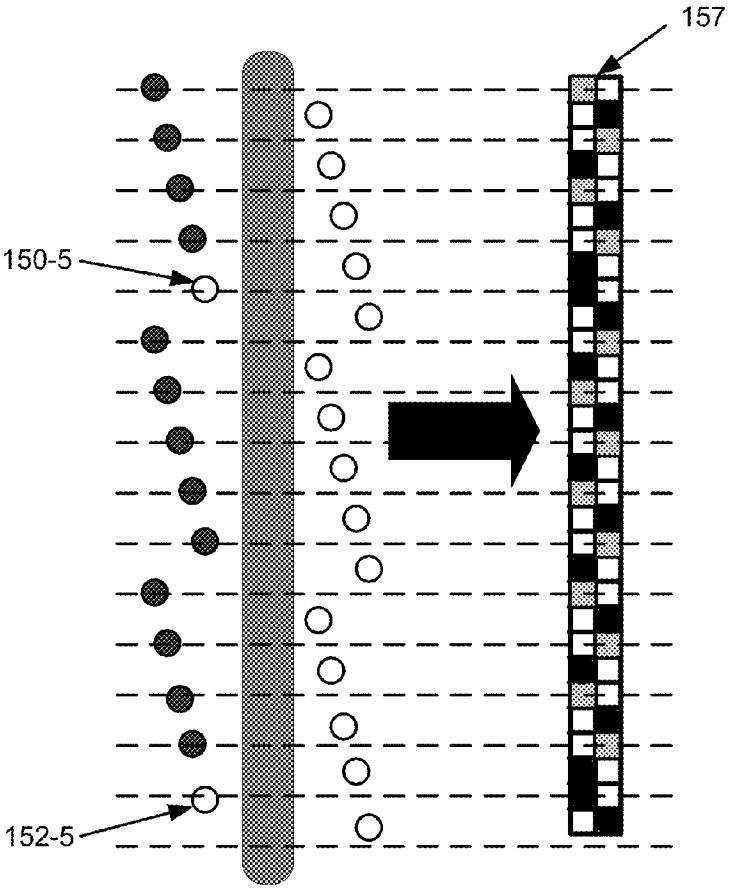
Figure 6K:
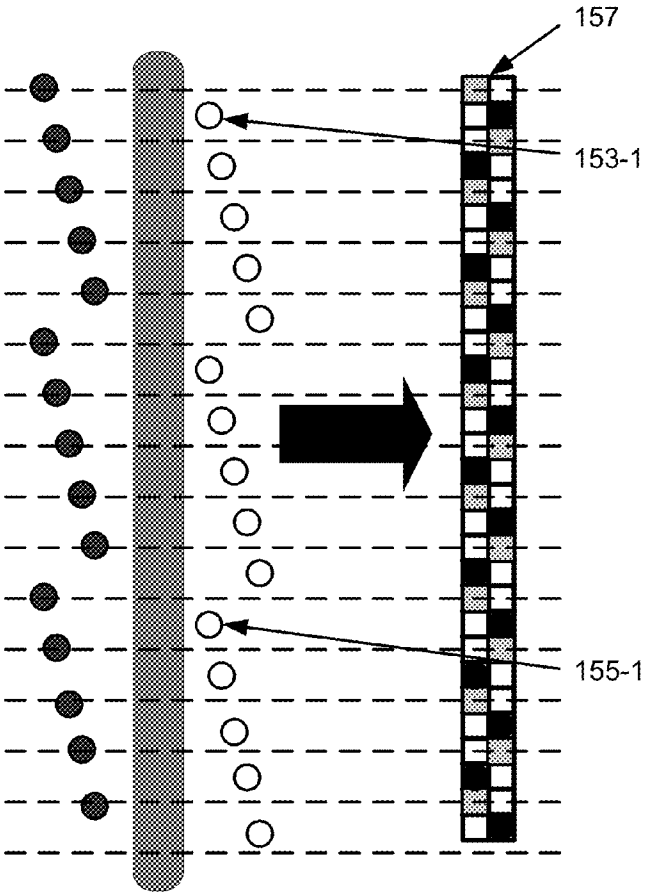
Figure 6N:
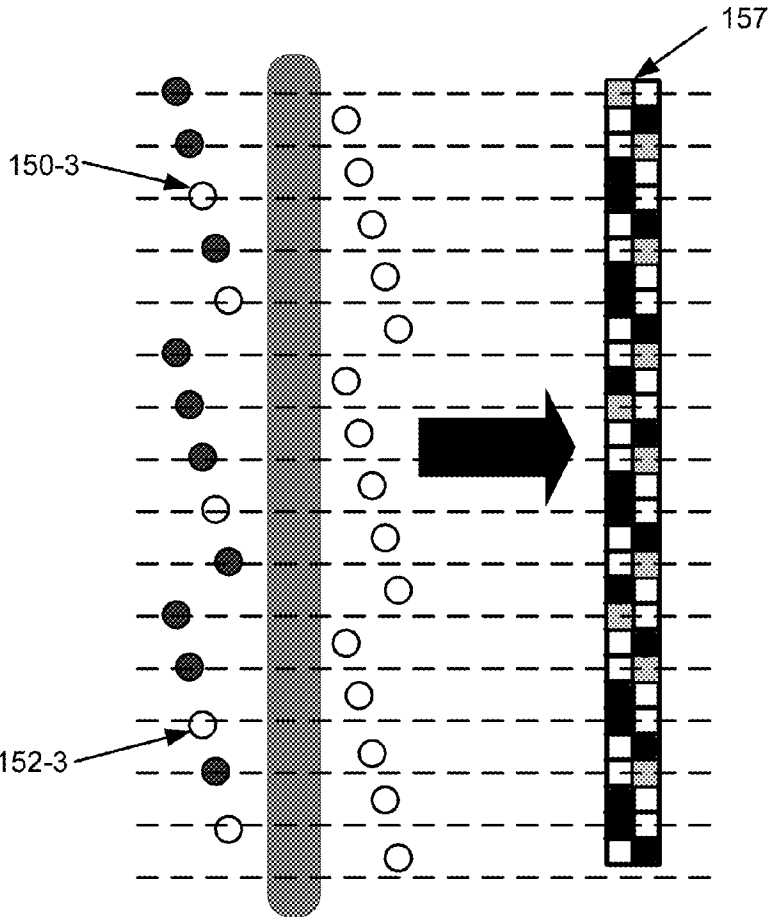
Figure 6M:
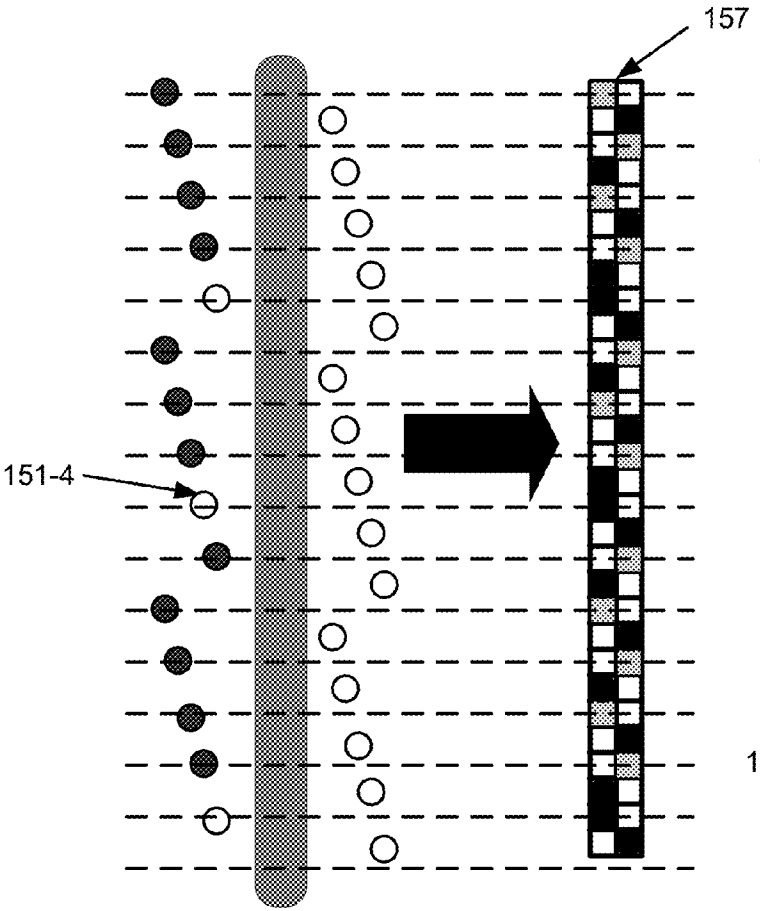
Figure 6P:
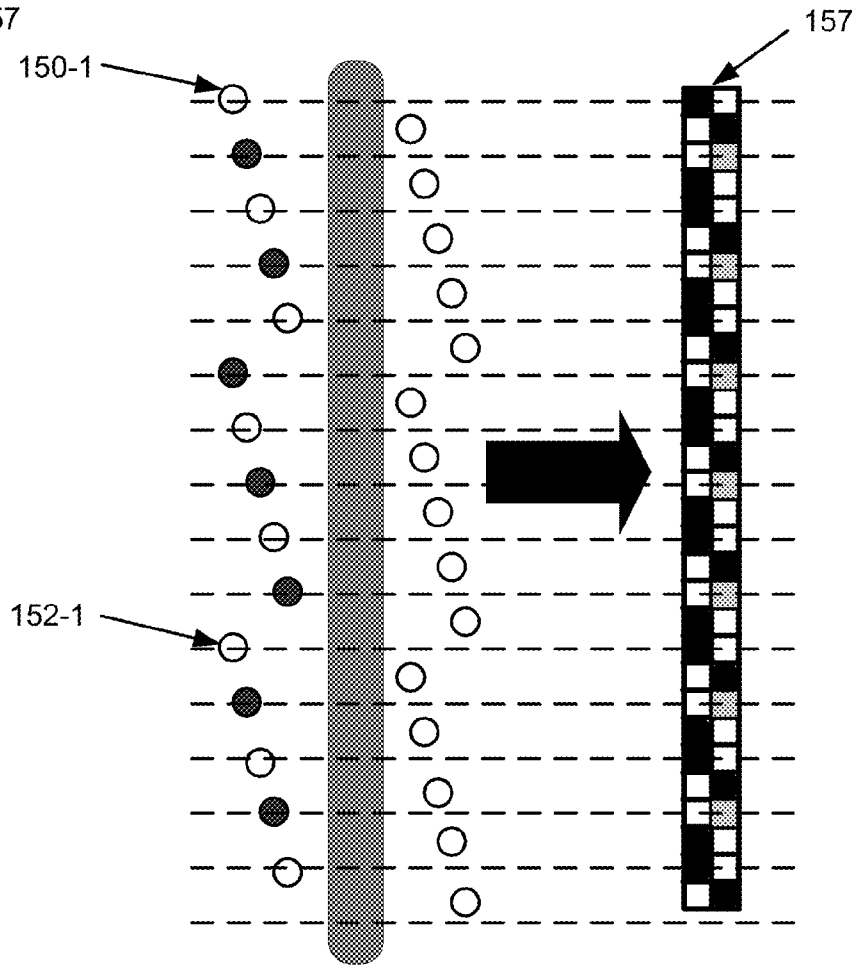
Figure 6O:
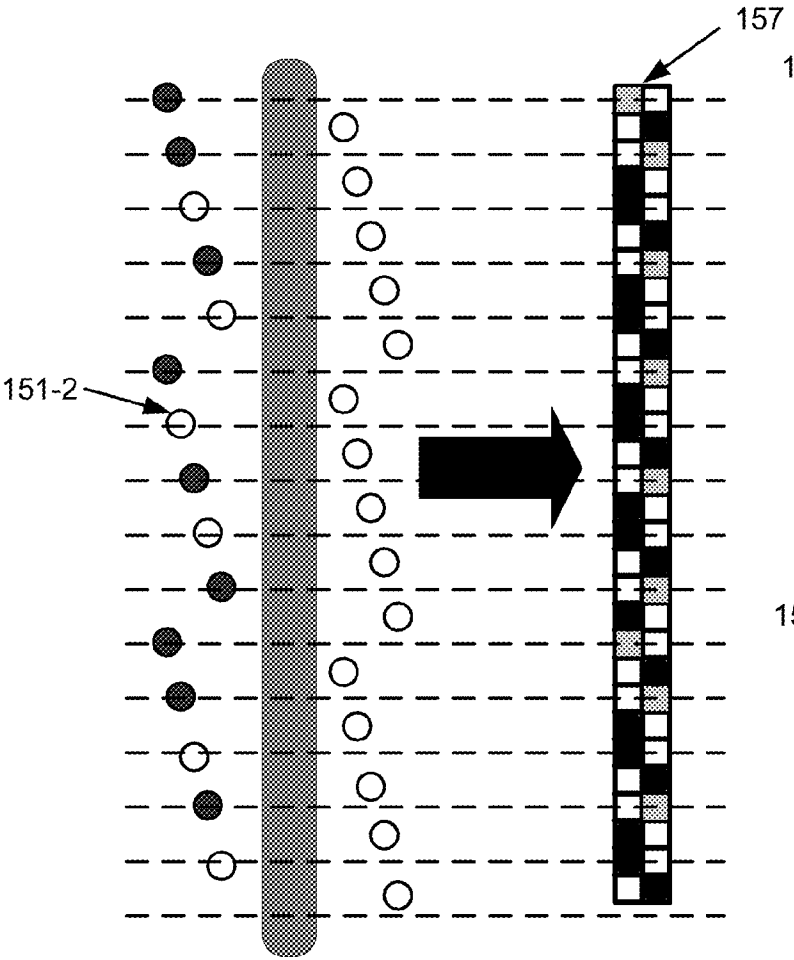
Figure 6R:
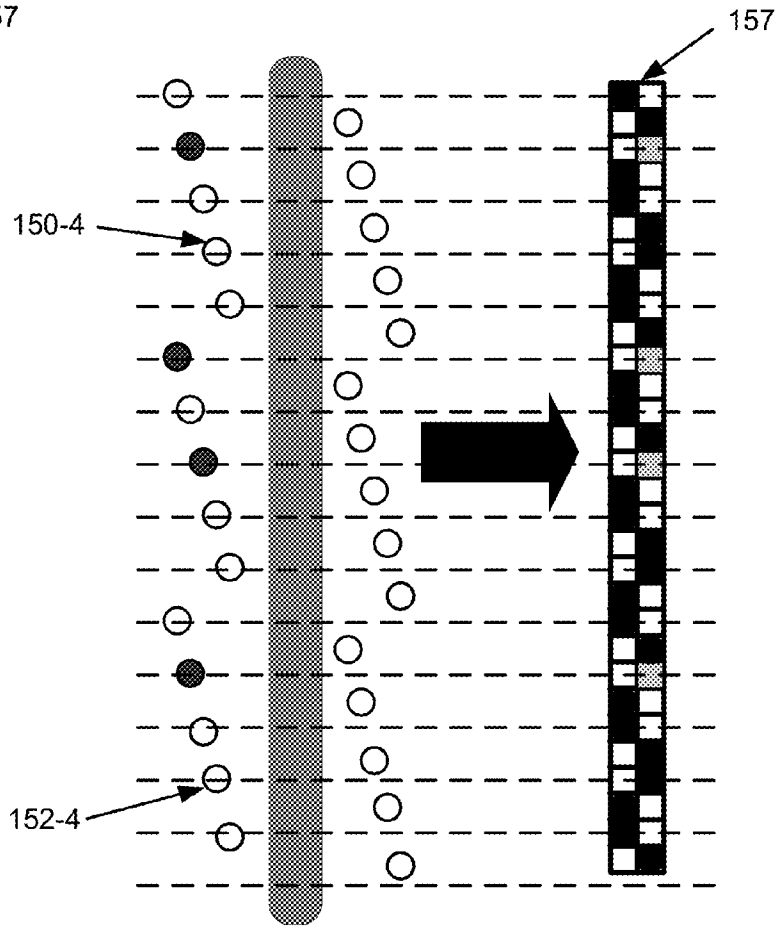
Figure 6Q:
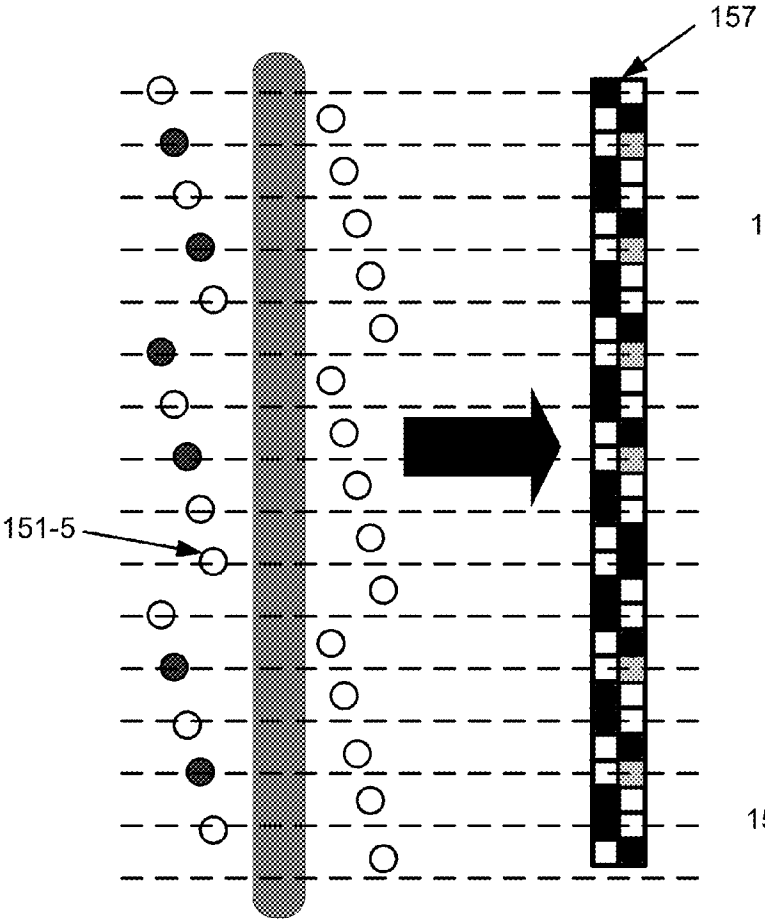
Figure 6T:
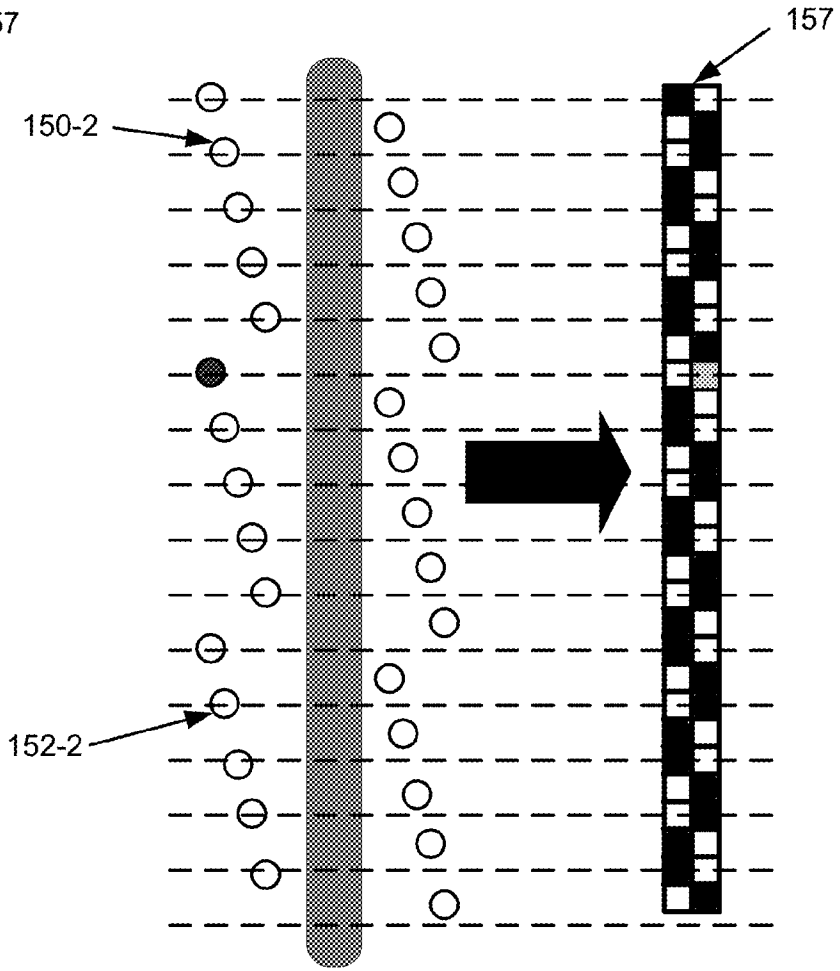
Figure 6S:
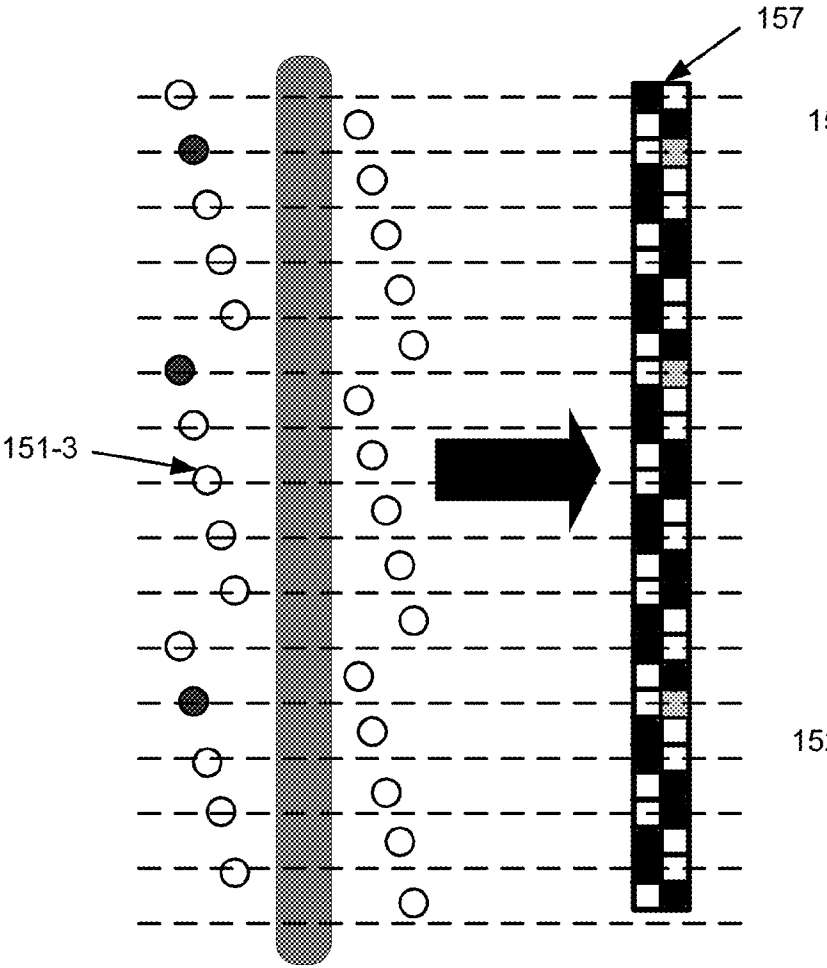
Figure 6U:
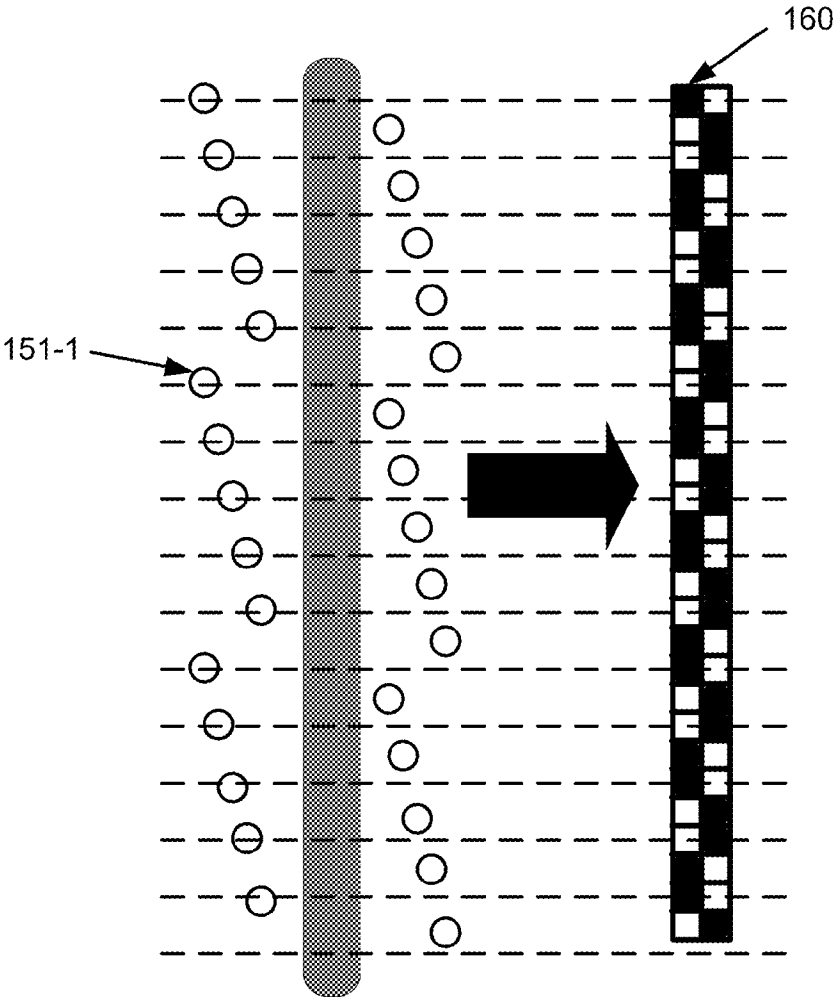

In order to reduce the peak energy usage, FIGS. 6A-6U illustrate an example of another sequential firing order for the printhead 101 of FIGS. 5A-5K.

Referring to FIGS. 6A and 6B, in order to print pattern 160 of FIG. 6U (i.e., the print pattern of FIG. 4), in FIG. 6B, the nozzle addressed 154-5 may be fired at the print media 157. Referring to FIG. 6C, then subsequently the nozzles 153-3 and 155-4 may be fired at the print media 157. Referring to FIG. 6D, then subsequently the nozzle 154-3 may be fired at the print media 157. Referring to FIG. 6E, then subsequently the nozzles 153-2 and 155-2 may be fired at the print media 157. Referring to FIG. 6F, then subsequently the nozzle 154-1 may be fired at the print media 157. Referring to FIG. 6G, then subsequently the nozzles 153-5 and 155-5 may be fired at the print media 157. Referring to FIG. 6H, then subsequently the nozzle 154-4 may be fired at the print media 157. Referring to FIG. 6I, then subsequently the nozzles 153-3 and 155-3 may be fired at the print media 157. Referring to FIG. 6J, then subsequently the nozzle 154-2 may be fired at the print media 157. Referring to FIG. 6K, then subsequently the nozzles 153-1 and 155-1 may be fired at the print media 157. Referring to FIG. 6L, then subsequently the nozzles 150-5 and 152-5 may be fired at the print media 157. Referring to FIG. 6M, then subsequently the nozzle 151-4 may be fired at the print media 157. Referring to FIG. 6N, then subsequently the nozzles 150-3 and 152-3 may be fired at the print media 157. Referring to FIG. 6O, then subsequently the nozzle 151-2 may be fired at the print media 157. Referring to FIG. 6P, then subsequently the nozzles 150-1 and 152-1 may be fired at the print media 157. Referring to FIG. 6Q, then subsequently the nozzle 151-5 may be fired at the print media 157. Referring to FIG. 6R, then subsequently the nozzles 150-4 and 152-4 may be fired at the print media 157. Referring to FIG. 6S, then subsequently the nozzle 151-3 may be fired at the print media 157. Referring to FIG. 6T, then subsequently the nozzles 150-2 and 152-2 may be fired at the print media 157. Referring to FIG. 6U, then subsequently the nozzle 151-1 may be fired at the print media 157.

Thus, referring to FIGS. 6A-6U, compared to the firing sequence of FIGS. 5A-5K, for any given moment in time, two or less primitives on one side of the slot 156 are fired. This results in a reduced peak energy use for each firing event. If the number of primitives are increased (e.g., 48 primitives on each side of the slot 156), compared to the firing sequence of FIGS. 5A-5K, at most one-half of the primitives on any side of the slot 156 are fired. This results in a peak instantaneous energy use of approximately 50% of the maximum peak instantaneous energy use for the firing sequence of FIGS. 5A-5K. Further, although FIGS. 6A-6U show three primitives per side of the slot 156 and a sequential firing order, a larger number of primitives may also be used with a non-sequential firing order to reduce crosstalk. However, even with a larger number of primitives and non-sequential firing order, for any given firing event, the resulting peak energy is approximately 50% of the maximum peak energy use for the firing sequence of FIGS. 5A-5K. Thus, the primitive design and expansion mask may be chosen to assure that all nozzles with the same address are not fired simultaneously. For example, an odd numbers of nozzles per primitive with certain even-sized expansion masks may be used. Alternatively, an even number of nozzles per primitive with an expansion mask that repeats with an odd number of nozzles may be used. Generally, the printhead system may include a number of nozzles per primitive and an expansion mask combination, such that all nozzles with the same address on the printhead on either side of the slot 156 do not fire at the same time.

Figure 7:
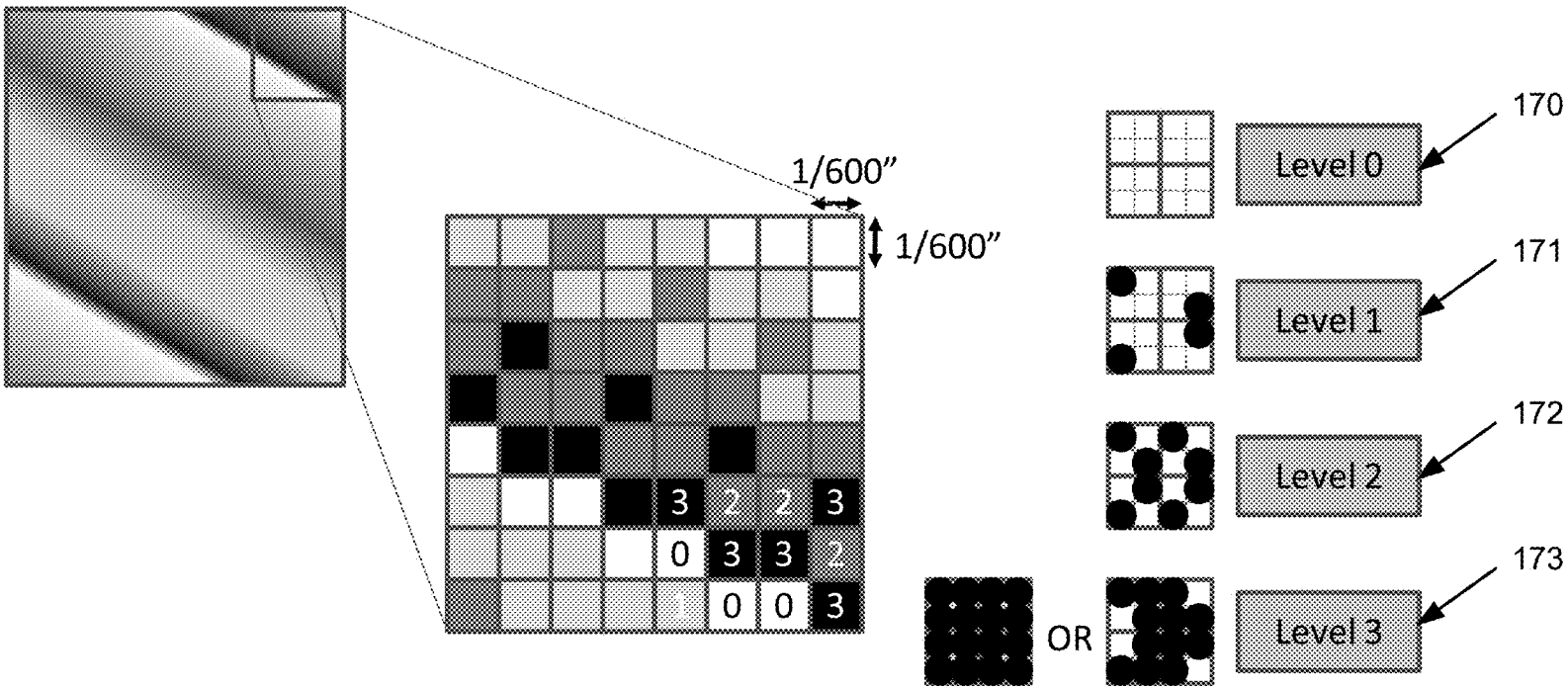
FIG. 7 illustrates an example of graphics for the printhead of FIGS. 5A-5K and 6A-6U, according to an example of the present disclosure.

FIG. 7 illustrates an examples of graphics for the printhead 101 of FIGS. 5A-5K and 6A-6U, according to an example of the present disclosure. Referring to FIG. 7, incoming data for the printhead system 100 may be at 2-bits. For the four gray levels shown at 170, 171, 172 and 173, gray level 170 may indicate a white pixel (i.e., no dots). Gray level 171 may indicate a pixel with one dot. Gray level 172 may indicate a pixel with two dots. Gray level 173 may indicate pixels with three or four dots. As discussed above, the printhead system 100 may limit peak pixel fill density to 50% of available pixels, and ink fill density to a maximum of two drops per pixel. Thus, for blackout printing, the system 100 may use gray level 172 to achieve saturated ink density, without using gray level 173.

Figures 8A, 8B, 8C:
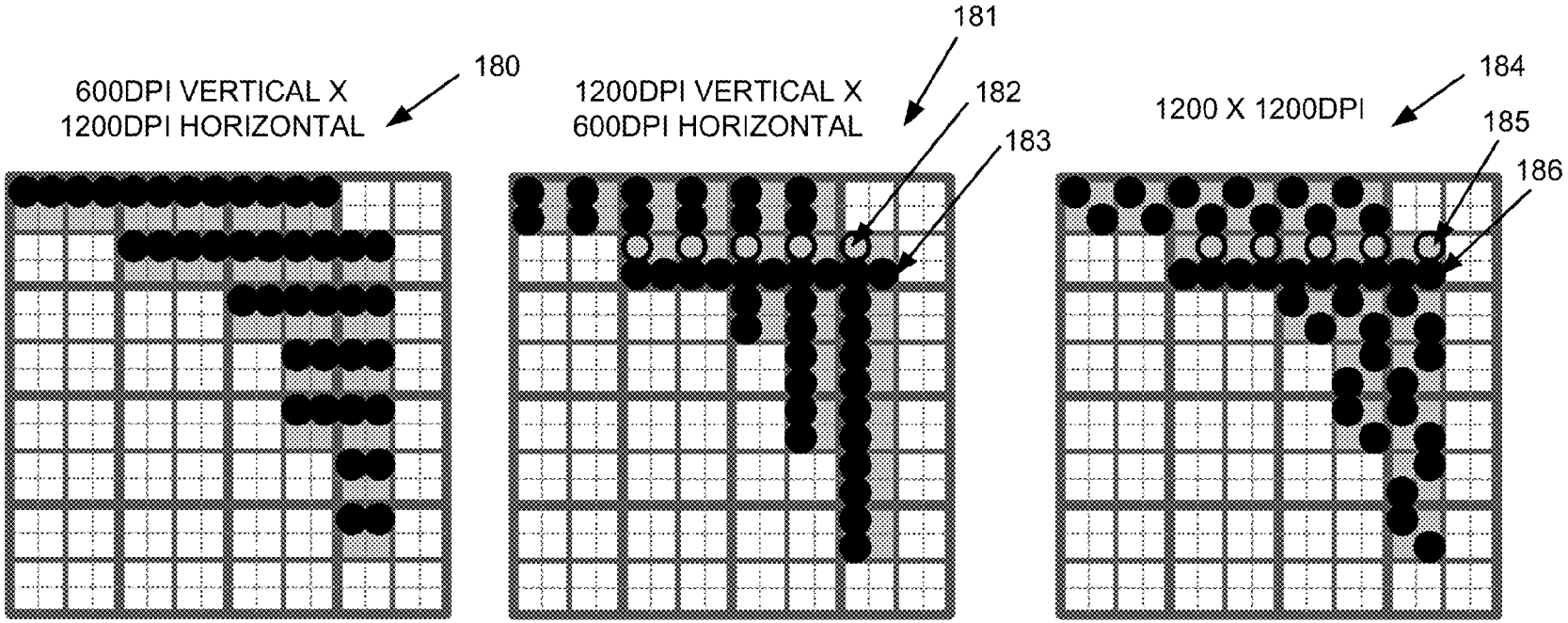
FIGS. 8A-8C illustrate examples of nozzle replacement options, according to an example of the present disclosure.

FIGS. 8A-8C illustrate examples of nozzle replacement options, according to an example of the present disclosure. FIG. 8A illustrates an example of a horizontal print pattern 180 (see also FIG. 2) based on low nozzle density and high fluidic frequency. For FIG. 8A, the print pattern 180 does not include sufficient vertical resolution in the printhead for nozzle replacement. FIG. 8B illustrates an example of a vertical print pattern 181 (see also FIG. 3) based on high nozzle density and low fluidic frequency. For FIG. 8B, the print pattern 181 allows for nozzle replacement. For example, if nozzles corresponding to row 182 are damaged, a neighboring nozzle may be used instead, for example, to fill in the row 183. In this manner, the two drops per pixel ink fill density may be achieved, although, as discussed above, the pattern of FIG. 8B still uses high peak energy. FIG. 8C illustrates an example of a checkerboard print pattern 184 (see also FIG. 4) based on high nozzle density and high electrical frequency. For FIG. 8C, the print pattern 184 also allows for nozzle replacement. For example, if nozzles corresponding to row 185 are damaged, a neighboring nozzle may be used instead, for example, to fill in the row 186. In this manner, the two drops per pixel ink fill density may be achieved. Although for the dots of the row 186, the printhead system 100 may use 100% peak electricity current, since a printhead may include thousands of nozzles, the average peak electrical current may still equate to approximately 50% peak electrical current compared to the print pattern of FIG. 8B.

For the printhead system 100, the printhead 101 may include, for example, nozzles disposed with a spacing of 1/1200 inch in two interlaced columns. The system 100 may include, for example, 9 ng drops. For printing in a single pass, the nozzle density may also be denoted the vertical resolution of the print. A higher effective vertical resolution may be obtained by offsetting the printhead with multiple pass printing. For the printhead 101, for plain paper print-modes, the printhead system 100 may provide for firing of drops every 1/1200 inch for every nozzle for 1200 dpi horizontal resolution. This configuration may provide for the printing of droplets anywhere on a 1200×1200 dpi grid.

For the printhead system 100, in an example, the system 100 may use approximately 18 ng of ink for every 600 dpi square pixel to obtain a fully saturated black. Because there are four 1200 dpi pixels for each 600 dpi pixel, the system 100 may provide for approximately 50% of the 1200 dpi pixels to be filled with black ink in order to obtain full saturation. For this example, the two out of the four pixels that receive ink may be selected as discussed above with reference to FIGS. 4 and 6A-6U. In another example, the system 100 may use a different ratio of ink per dpi. For example, based on the use of depletion to calibrate for variation, the system 100 may provide for filling below full saturation to allow for reduction of the total ink printed. Based on the use of depletion to calibrate for variation, the system 100 may use, for example, 8 ng drops and 16 ng per 600 dpi pixel.

Referring to FIGS. 6A-6U, compared to the five nozzles shown per primitive, alternatively, the system 100 may also include, for example, eleven nozzles per primitive for supporting expansion masks sized at 600 dpi. The printhead 101 may include ink drops ranging from approximately 1 ng to approximately 20 ng per drop. The printhead 101 may include 300-2400 nozzles per inch. The system 100 may use approximately 10 ng/600 dpi pixel up to approximately 30 ng/600 dpi pixel.

With increased resolution, the printhead system 100 may provide for higher peak energy reduction. For example, if horizontal resolution is increased from 1200 to 2400 dpi, and maximum fill is decreased to approximately 25%, the printhead system 100 may obtain approximately another 50% energy reduction (i.e., approximately 75% total energy reduction) in peak current. In this case, the system 100 may use a further increased electrical frequency capability (e.g., doubled) and a further increased data rate of information sent to the printhead (e.g., doubled).

For a specific example, the printhead system 100 may be used for printing in a single pass with a page-wide printhead including 11 nozzles/primitive. The single pass printing with a large number of nozzles benefit from the foregoing nozzle redundancy and replacement capabilities of the printhead system 100.

Figure 9:
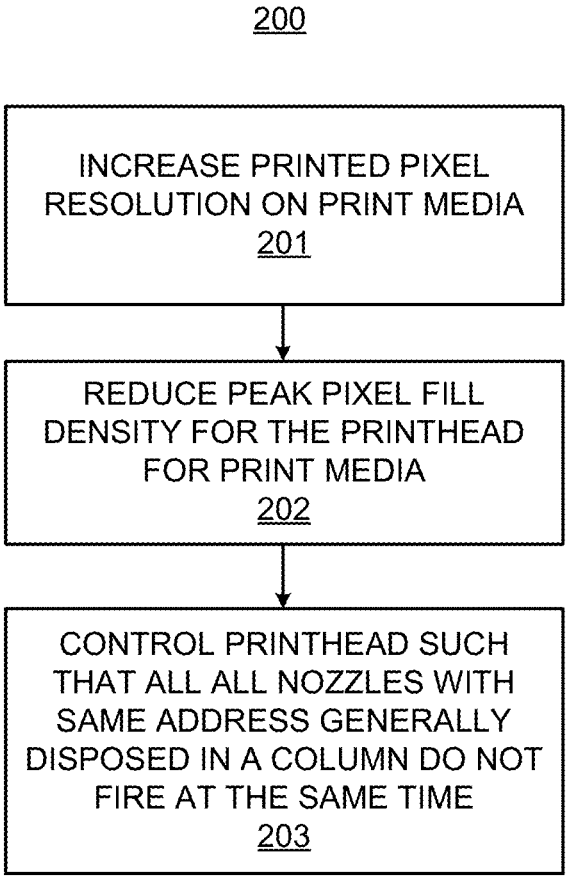
FIG. 9 illustrates a flowchart of a method for reducing peak energy usage in a printhead, according to an example of the present disclosure.

FIG. 9 illustrates a flowchart of a method 200 for reducing peak energy usage in a printhead, according to an example of the present disclosure. The method 200 may be implemented on the printhead system described above with reference to FIGS. 4, 6A-6U, 7 and 8C by way of example and not limitation. The method 200 may be practiced in other systems.

Referring to FIG. 9, at block 201, the method may include increasing printed pixel resolution on the printed media. For example, the printhead system 100 may include an increase in printed pixel resolution. For example, the electrical frequency may be set such that a print drop may be fired at twice the resolution indicated for a file. For example, a 600 dpi print amount may be electrically printed at 1200 dpi (i.e., twice the electrical density).

At block 202, the method may include reducing peak pixel fill density for the printhead for print media. For example, as discussed above with reference to FIG. 1, the amount of ink used to produce a saturated color may be approximately 18 ng per 600 dpi pixel (i.e., 18 ng/600$^{th}$ for black ink). For approximately 9 ng per drop, the amount of ink used to produce a saturated color may equate to approximately two drops per 600 dpi pixel. For example, for printing in 1200×1200 dpi mode, electrically, there are four locations within a 600 dpi pixel where a drop of ink may be placed. Therefore, half of the possible locations are to be printed to obtain a saturated color. Thus, two drops are to be printed to obtain a saturated color. Further, FIG. 4 illustrates the example of the checkerboard print pattern 140 based on high nozzle density and high electrical frequency, according to an example of the present disclosure. For example, FIG. 4 may illustrate a 1200×1200 dpi print pattern. As shown in FIG. 4, the printhead control module 102 may control the printhead 101 to limit peak pixel fill density to 50% of available pixels, and ink fill density to a maximum of two drops per pixel. For FIG. 4, the printhead control module 102 may control the printhead 101 to print the dot 141, and then the dot 142 as described in detail with reference to FIGS. 6A-6U. For the checkerboard print pattern 140 of FIG. 4, for printing of the dots 141 and 142, the printhead system 100 may use at most approximately 50% peak electrical current. This reduction in peak electrical current may produce more uniform energy distribution by reducing parasitic electrical losses.

At block 203, the method may include controlling the printhead such that all nozzles with the same address generally disposed in a column do not fire at the same time. For example, referring to FIGS. 6A-6U, for any given firing event, two or less nozzles on one side of the slot 156 are fired for each time step. This results in a reduced peak energy use for each firing event. If the number of primitives are increased (e.g., 48 primitives on each side of the slot 156), compared to the firing sequence of FIGS. 5A-5K, at most one-half of the primitives on any side of the slot 156 are fired. This results in a peak energy use of approximately 50% of the maximum peak energy use for the firing sequence of FIGS. 5A-5K. Further, although FIGS. 6A-6U show three primitives per side of the slot 156 and a sequential firing order, a larger number of primitives may also be used with a non-sequential firing order to reduce crosstalk. However, even with a larger number of primitives and non-sequential firing order, for any given firing event, the resulting peak energy is approximately 50% of the maximum peak energy used for the firing sequence of FIGS. 5A-5K. Thus, the primitive design and expansion mask may be chosen to assure that all nozzles with the same address are not fired simultaneously. For example, an odd numbers of nozzles per primitive with certain even-sized expansion masks may be used. Alternatively, an even number of nozzles per primitive with an expansion mask that repeats with an odd number of nozzles may be used. Generally, the printhead system may include a number of nozzles per primitive and an expansion mask combination, such that all the nozzles with a same address generally disposed in a column do not fire at the same time.

Figure 10:
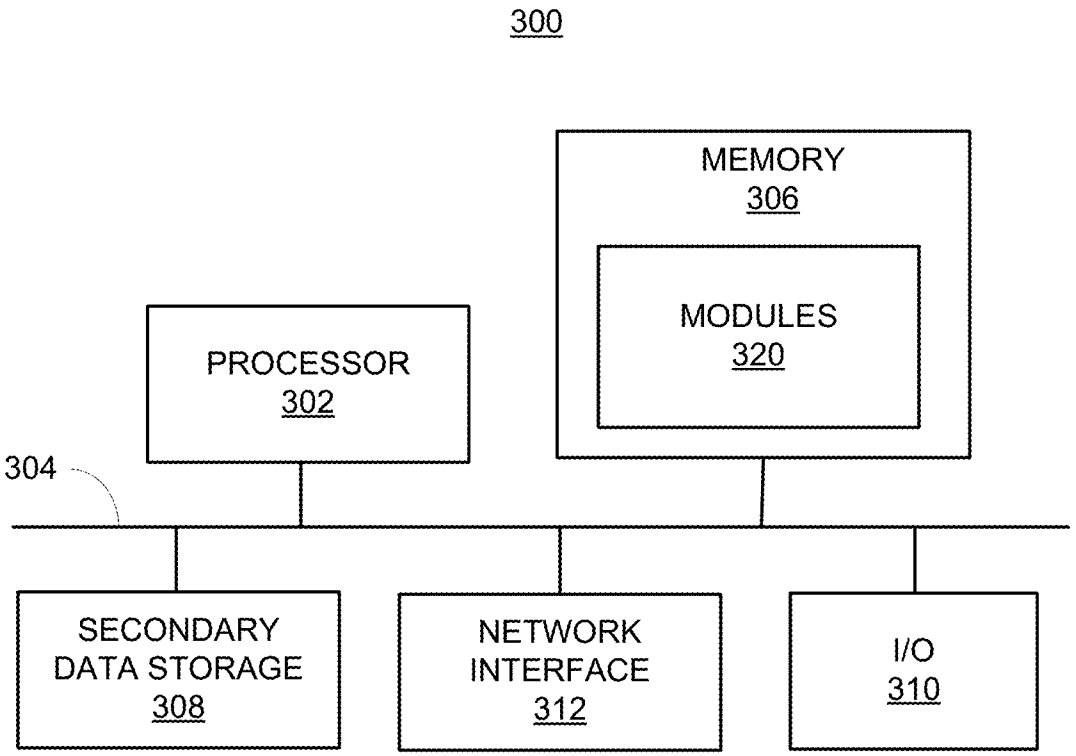
FIG. 10 illustrates a computer system, according to an example of the present disclosure.

FIG. 10 shows a computer system 300 that may be used with the examples described herein. The computer system 300 may be used as part of a platform for the system 100. For example, some or all of the components of the computer system 300 may be incorporated in a printer including the features of the system 100. The computer system 300 may execute, by a processor or other hardware processing circuit, the methods, functions and other processes described herein. These methods, functions and other processes may be embodied as machine readable instructions stored on computer readable medium, which may be non-transitory, such as hardware storage devices (e.g., RAM (random access memory), ROM (read only memory), EPROM (erasable, programmable ROM), EEPROM (electrically erasable, programmable ROM), hard drives, and flash memory).

The computer system 300 includes a processor 302 that may implement or execute machine readable instructions performing some or all of the methods, functions and other processes described herein. Commands and data from the processor 302 are communicated over a communication bus 304. The computer system 300 also includes a main memory 306, such as a random access memory (RAM), where the machine readable instructions and data for the processor 302 may reside during runtime, and a secondary data storage 308, which may be non-volatile and stores machine readable instructions and data. The memory and data storage are examples of computer readable mediums. The memory 306 may include modules 320 including machine readable instructions residing in the memory 306 during runtime and executed by the processor 302. The modules 320 may include, for example, the printhead control module 102 of the system 100 shown in FIG. 6A.

The computer system 300 may include an I/O device 310, such as a keyboard, a mouse, a display, etc. The computer system 300 may include a network interface 312 for connecting to a network. Other known electronic components may be added or substituted in the computer system 300.

What has been described and illustrated herein is an example along with some of its variations. The terms, descriptions and figures used herein are set forth by way of illustration only and are not meant as limitations.

What is claimed is:

1. A printhead system to reduce peak energy usage, the printhead system comprising:

a printhead including a plurality of primitives including nozzles; and a printhead control module to control the printhead to increase printed pixel resolution and to reduce peak pixel fill density for print media, the printhead control module to further control the printhead such that all the nozzles with a same address generally disposed in a column do not fire at the same time.

2. The printhead system of claim 1, wherein the plurality of primitives are disposed on opposite sides of a slot and include the nozzles disposed in a pattern such that each nozzle fires a unique drop on the print media.

3. The printhead system of claim 1, wherein the nozzles are disposed in a staggered pattern.

4. The printhead system of claim 1, wherein each primitive includes an odd number of the nozzles along with an expansion mask that has a pattern that repeats with an even number of pixels.

5. The printhead system of claim 1, wherein each primitive includes an even number of the nozzles along with an expansion mask that repeats with an odd number of pixels.

6. The printhead system of claim 1, wherein the printhead control module is to control the printhead to increase the printed pixel resolution to approximately double electrical density for printing.

7. The printhead system of claim 1, wherein the printhead control module is to control the printhead to limit the peak pixel fill density to approximately 50% of available pixels.

8. The printhead system of claim 1, wherein the printhead control module is to control the printhead to limit ink fill density to approximately two drops per pixel.

9. The printhead system of claim 8, wherein the printhead control module is to control the printhead to place the drops on the print media in a checkerboard pattern.

10. The printhead system of claim 9, wherein the checkerboard pattern includes an alternating sequence of the drops.

11. The printhead system of claim 1, wherein the printhead control module is to control the printhead such that one-half of electrically available resistors for firing the nozzles are turned on at any given time.

12. The printhead system of claim 1, wherein the printhead control module is to control the printhead to provide for nozzle replacement capabilities with reduced peak energy usage.

13. A method for reducing peak energy usage in a printhead, the method comprising:

increasing printed pixel resolution of the printhead;

reducing peak pixel fill density for the printhead for print media; and controlling, by a processor, the printhead such that all addresses on the printhead that share electrical power routing lines do not fire at the same time.

14. A printer comprising:

a printhead including a plurality of primitives including nozzles; and a printhead control module to control the printhead to increase printed pixel resolution and to reduce peak pixel fill density for print media, the printhead control module further controlling the printhead such that all the nozzles with a same address generally disposed in a column do not fire at the same time.

15. The printer of claim 14, wherein the printer includes single pass printing.

* * * * *

UNITED STATES PATENT AND TRADEMARK OFFICE

CERTIFICATE OF CORRECTION

PATENT NO. : 9,028,031 B2
APPLICATION NO. : 14/374807
DATED : May 12, 2015
INVENTOR(S) : Garrett E. Clark et al.

It is certified that error appears in the above-identified patent and that said Letters Patent is hereby corrected as shown below:

In the Drawings

In sheet 22 of 23, reference numeral 203, line 2, delete "ALL ALL" and insert -- ALL --, therefor.

Signed and Sealed this
Twenty-first Day of June, 2016

Michelle K. Lee

Michelle K. Lee
*Director of the United States Patent and Trademark Office*